US011524185B2

(12) United States Patent
Kils et al.

(10) Patent No.: US 11,524,185 B2
(45) Date of Patent: Dec. 13, 2022

(54) CLOSURE SYSTEM

(71) Applicant: CMC RESCUE, INC., Goleta, CA (US)

(72) Inventors: Ole Kils, Goleta, CA (US); Shaun Reed, Golden, CO (US); Ryan Schaafsma, Santa Barbara, CA (US); Tyler Mayer, Carpinteria, CA (US)

(73) Assignee: CMC RESCUE, INC., Goleta, CA (US)

( * ) Notice: Subject to any disclaimer, the term of this patent is extended or adjusted under 35 U.S.C. 154(b) by 697 days.

(21) Appl. No.: 16/399,780

(22) Filed: Apr. 30, 2019

(65) Prior Publication Data

US 2020/0306566 A1 Oct. 1, 2020

Related U.S. Application Data

(60) Provisional application No. 62/827,520, filed on Apr. 1, 2019.

(51) Int. Cl.
*A62B 35/00* (2006.01)
*A62B 1/14* (2006.01)

(52) U.S. Cl.
CPC ..... *A62B 1/14* (2013.01); *A62B 35/0081* (2013.01)

(58) Field of Classification Search
CPC ..... A62B 1/10; A62B 1/14; A62B 35/0081; A62B 35/005; A63B 29/02
See application file for complete search history.

(56) References Cited

U.S. PATENT DOCUMENTS

| | | | | |
|---|---|---|---|---|
| 686,154 | A | 11/1901 | Smith | |
| 2,649,282 | A | 8/1953 | Fate, Jr. | |
| 4,494,782 | A * | 1/1985 | Lutz | E05B 81/25 292/96 |
| 4,614,332 | A | 9/1986 | Wilson | |
| 5,845,894 | A | 12/1998 | Petzl et al. | |
| 7,168,687 | B2 | 1/2007 | Thompson | |
| 7,669,835 | B2 | 3/2010 | Thompson | |
| 7,845,467 | B2 * | 12/2010 | Petzl | A62B 1/14 182/71 |
| 8,281,895 | B2 * | 10/2012 | Gassner | A62B 35/0087 182/8 |
| 8,348,016 | B2 * | 1/2013 | Lewis | A62B 1/14 182/5 |
| 9,289,834 | B2 | 3/2016 | Chabod et al. | |
| 9,504,861 | B2 * | 11/2016 | Jones | A62B 35/0081 |
| 10,035,028 | B1 * | 7/2018 | Siegel | A62B 1/06 |
| 2012/0241700 | A1 * | 9/2012 | Mauthner | A62B 1/14 254/391 |

(Continued)

FOREIGN PATENT DOCUMENTS

FR 2748078 B1 10/1997

*Primary Examiner* — Colleen M Chavchavadze
(74) *Attorney, Agent, or Firm* — McCoy Russell LLP

(57) ABSTRACT

A closure system for a line-engaging device is herein disclosed. The closure system comprises a latch for securing the line-engaging device in a closed position by engaging with one or more of a plurality of keepers in the device body. The configuration of the latch and the keepers is such that transition from a closed position of the closure system to an open position of the closure system may only occur following two or more actuations of the latch, this may reduce the probability of unintentional disengagement of a line or cable from the device.

15 Claims, 16 Drawing Sheets

(56) References Cited

U.S. PATENT DOCUMENTS

| | | | | |
|---|---|---|---|---|
| 2014/0262611 | A1* | 9/2014 | Oddou | A62B 1/14<br>182/5 |
| 2016/0287913 | A1* | 10/2016 | Bell | A62B 1/20 |
| 2017/0189725 | A1* | 7/2017 | Malcolm | A63B 29/02 |

* cited by examiner

CLOSURE SYSTEM

CROSS REFERENCE TO RELATED APPLICATIONS

The present application claims priority to U.S. Provisional Application No. 62/827,520, entitled "CLOSURE SYSTEM", and filed on Apr. 1, 2019. The entire contents of the above-listed application are hereby incorporated by reference for all purposes.

FIELD

The present description relates generally to a closure system which may be used to secure a line in a line-engaging device.

BACKGROUND/SUMMARY

Rope or cable engaging devices (herein referred to as line-engaging devices), such as snatch blocks, descenders, and ascenders, have applications in many different activities, including rock climbing, mountaineering, caving, and mountain rescue work. Line-engaging devices are also employed in applications such as sailing and other marine applications, in urban and industrial rescue work, in safety restraints, in lifting and material handling, in law enforcement, in tree climbing, and in military applications, among many others.

A line-engaging device, such as a snatch block, may engage with a bight of rope, cable, or other elongated material (herein referred to as line) while the line-engaging device is in an open position. Following line engagement with the device, the line may be secured within the line-engaging device by actuation of the device to a closed position and actuation of a closure system of the line-engaging device to a locked position. Actuating the closure system to the locked position reduces the likelihood of the line-engaging device unintentionally accessing the open position, as may occur due to forces acting on the line or from collisions of the line-engaging device with other objects. By reducing the likelihood of unintentional opening of the line-engaging device, a likelihood of unintentional line disengagement from the device is also reduced. While in the locked position, the closure system may secure the line-engaging device in a closed position, wherein a sheave or line-engaging groove of the device is occluded, thus inhibiting engagement of a line, or disengagement of an engaged line. Conversely the unlocked position of the closure system may enable the rope engaging device to access an open position wherein the sheave or line-engaging groove is exposed, thereby enabling engagement of a disengaged line, or disengagement of an engaged line. In one example, engaging a line with the line-engaging device may include transitioning the closure system from a locked position to an unlocked position, and rotating a side plate of the line-engaging device about a pivot point away from a closed position, to an open position, thereby exposing a sheave or groove with which the line may engage. Once the line is engaged with the sheave or groove of the device, the side plate may be returned to the closed position by rotating the side plate about its pivot point. Upon returning to the closed position, the closure system may return to the locked position and prevent rotation of the side plate away from the closed position, thereby securing the line within the line-engaging device. Unlocking the closure system of the line-engaging device may be achieved by user actuation of the closure system, such as by movement of a finger operable switch from a primary position to a secondary position, thereby transitioning the closure system from a locked position to an unlocked position and enabling the line-engaging device to access the open position.

One example of a closure system is taught by Thompson in U.S. Pat. No. 7,168,687 (herein also referred to as Thompson). Thompson teaches a closure system which may be resiliently biased, unlockable with a single motion, for example by a single, substantially linear motion of a digit of a user's hand against the resilient bias, and rotationally operable by one hand of a user. Thus, the side plate may be released for pivotal movement and pivoted by the user to an open position with one hand to enable engagement or disengagement of a bight of line from the device. Similarly, the side plate may be pivoted back to a closed position and secured by transitioning the closure system to the locked position with one hand. The closure system of Thompson may comprise, for example, a spring-loaded button, or a resiliently biased pivotable latch, located in a body of a line-engaging device. An aperture or notch formed in the side plate of the device may be configured to engage with the button or latch.

However, the inventors herein have recognized potential issues with such closure systems. As one example, a closure system which is releasable by a single, substantially linear motion, is prone to unintentional release, such as may occur from contact of the button or latch of Thompson with a user, rock face, building, ice, or other objects, and may result in unexpected disengagement of the line from the line-engaging device and injury to the user. In another example, a resiliently biased closure system, releasable with a single motion, is prone to unintentional unlocking if the resilient bias of the closure system is damaged or impaired. In one example, a resiliently biased closure system of Thompson may comprise a spring loaded button, the button engaging with an aperture or notch in a side plate, and debris of rock, dirt, or ice may cause the button to jam in a position in which the button may not engage with the aperture or notch of the side plate, thus preventing the closure system from locking and securing a line within a line-engaging device. In another example, the resilient bias of the closure system of Thompson may be lost over time due to mechanical failure resulting from wear and tear on the resilient biasing mechanism of the closure system. In yet another example, rapid movement of the side plate may result in insufficient interaction time between the button or latch and the mating aperture or notch, thus providing insufficient time for engagement of the button or latch with the aperture or notch by action of the resilient biasing mechanism, which may prevent the closure system from locking.

In one example, the issues described above may be addressed by a closure system of a line-engaging device comprising a plurality of keepers in a body of the line-engaging device, an actuator and a latch pivotally mounted to a side plate of the line-engaging device, the closure system acuatable by operation of the actuator to a first position wherein the latch is engaged with a first keeper of the plurality of keepers, a second position wherein the latch is engaged with a second keeper of the plurality of keepers, a third position wherein the latch is engaged with a third keeper of the plurality of keepers, and a fourth position wherein the latch is not engaged with the plurality of keepers and a line may be engaged or disengaged with the line-engaging device. In this way, by providing a plurality of keepers in a body of the line-engaging device, the closure system may only transition from the first (locked) position to the fourth (unlocked) position upon transitioning through one or more intermediate positions via two or more actuations of an actuator, thus reducing a probability of unintentional unlocking of the closure system compared to the closure system taught by Thompson.

In another example, by providing a latch which engages a first keeper in a first position, and which engages a second keeper in a second position, wherein freeing the latch from the first keeper by actuation of an actuator causes the latch to engage the second keeper, no single position of the latch of the closure system enables the closure system to transition from a first (closed) position, to a fourth (open) position, without first occupying one or more intermediate (partially open) positions, wherein the closure system may only transition from the partially open positions to the fourth position upon additional actuation. In this way the probability of unintentional disengagement of a line from the line-engaging device is reduced compared to the closure system taught by Thompson.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a closure system of a line-engaging device and methods of operating the closure system. In a number of embodiments, the closure system comprises a latch pivotally coupled to a side plate by a pivot pin, an actuator coupled to the latch and capable of pivoting the latch about the pivot pin, and a plurality of keepers within a body of the line-engaging device. The plurality of keepers may comprise a first, second, and third keeper, which engage with, and retain, the latch in a one or more locked positions. It is understood that the closure system may comprise more than three keepers without departing from the scope of the current disclosure. The one or more locked positions of the closure system may prevent the line-engaging device from accessing an open position, wherein only the open position enables engagement or disengagement of a bight of line with the line-engaging device. Unlocking the closure system (transitioning the closure system from a locked position to an unlocked position) may necessarily comprise sequential actuation of the latch, by operation of the actuator, from the first, locked, position to a second position, and then from the second position to a third position, before actuating the latch from the third position to a fourth, unlocked, position. Said another way, actuating the closure system from the first, locked, position to the unlocked position may necessarily comprise actuating the latch from the first position, wherein the latch is engaged with a first keeper, to a second position, wherein the latch is engaged with a second keeper, then actuating the latch from the second position to a third position, wherein the latch is engaged with a third keeper, before actuating the latch from the third position to the fourth position, wherein the fourth position may be considered the unlocked position in which the latch is not engaged with the plurality of keepers and the line-engaging device may be actuated to open position. The closure system may transition from the fourth, unlocked position, back to the first, fully locked position, by substantially a single actuation, such as by rotating the side plate towards a closed position. By transitioning from the fully locked position, to the unlocked position, following two or more actuations, the closure systems taught herein may reduce a probability of unintentional disengagement of a line from a line-engaging device, compared to the closure system taught in Thompson.

Figure 1:
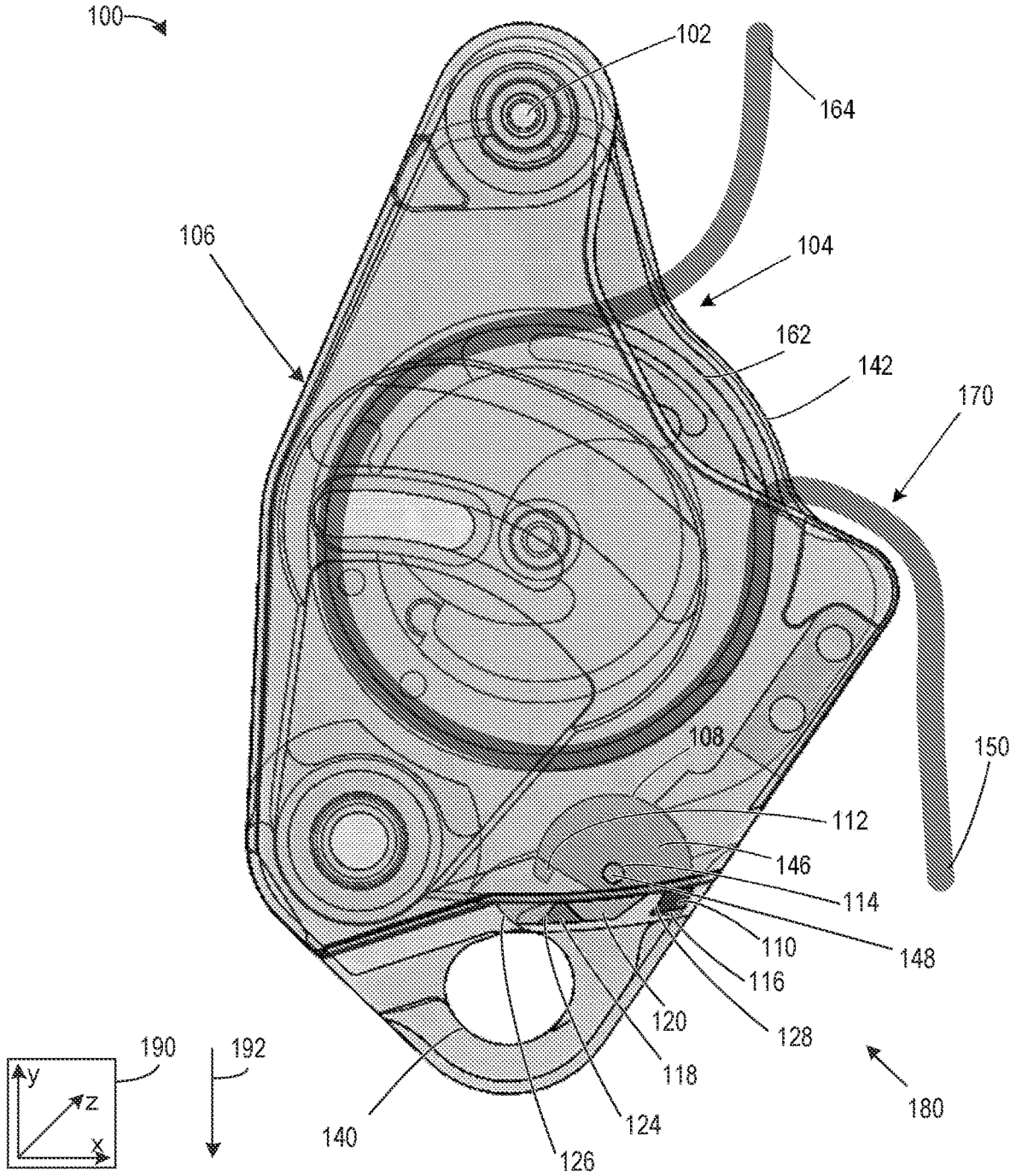
FIG. 1 shows an example of a line engaging device comprising a first embodiment of a closure system.
Figure 2:
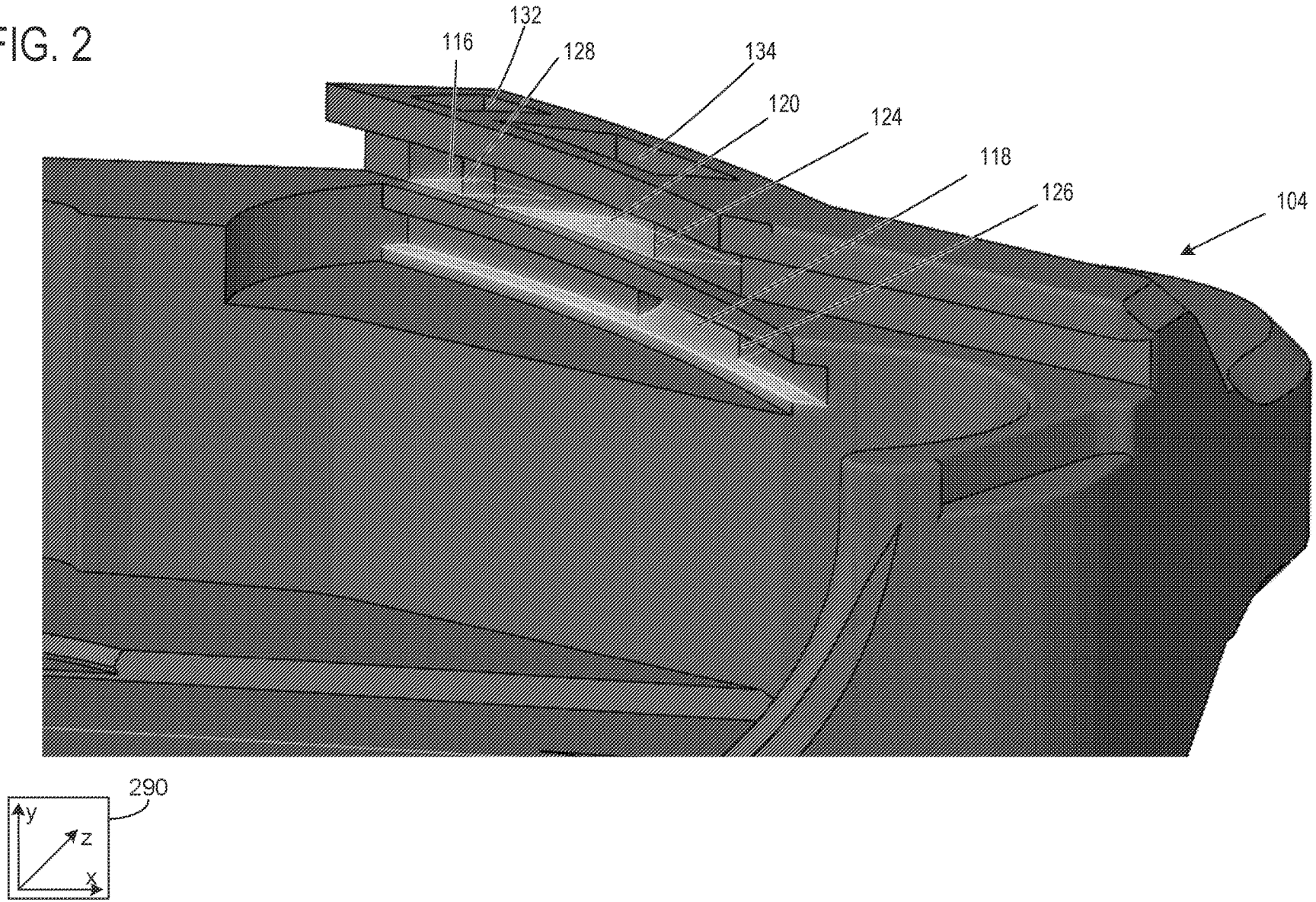
FIG. 2 shows an example of the keepers of the first embodiment of the closure system.
Figure 3:
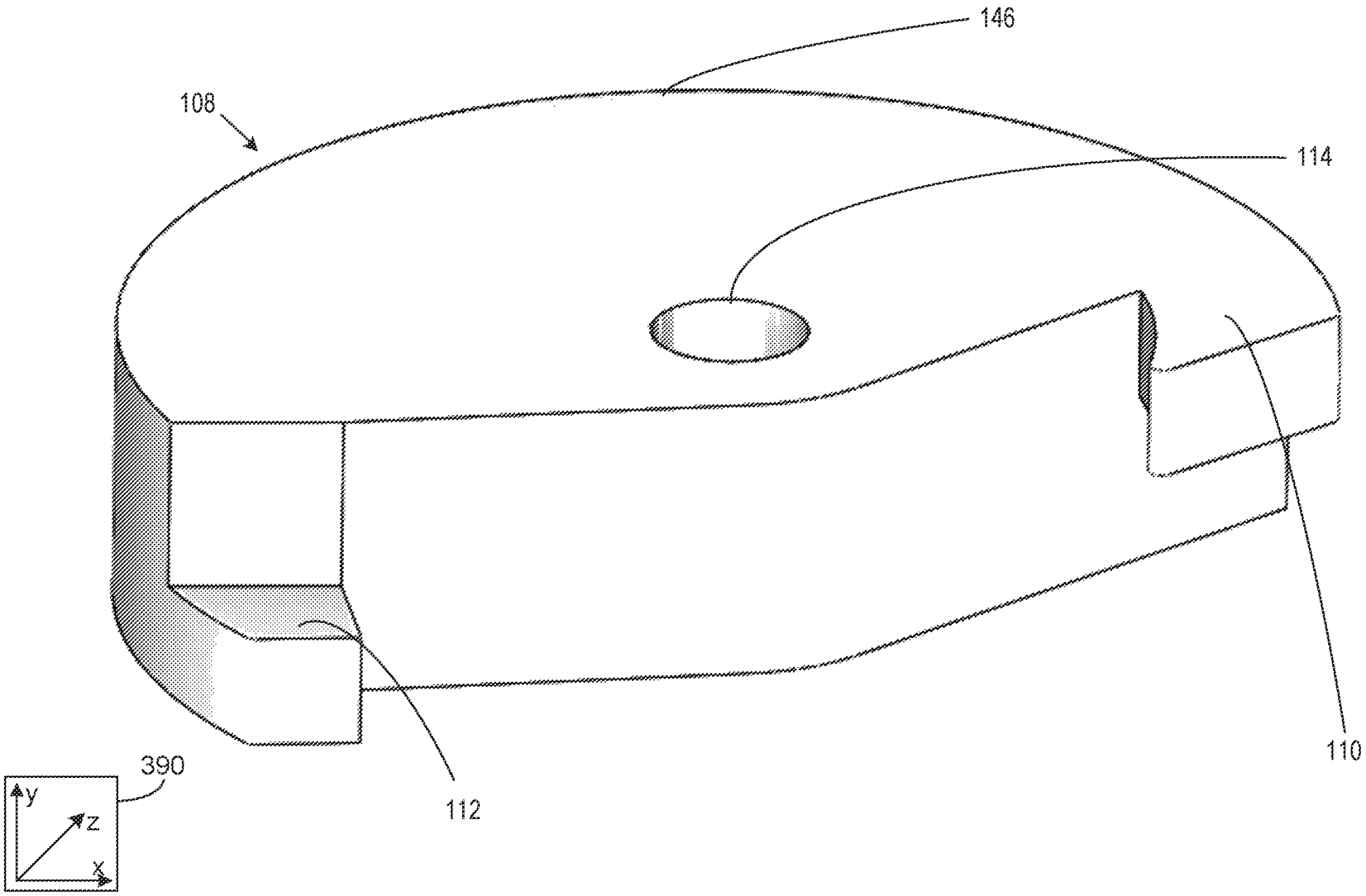
FIG. 3 shows an example of the latch of the first embodiment of the closure system.

The closure systems herein described may be used to secure a line, webbing, cable, or other elongated material (herein collectively referred to as line) in a snatchblock, pulley, descender, ascender, belay device, or other line-engaging device. FIG. 1, depicts an example line-engaging device 100. Example line-engaging device 100 is depicted as a descender, for assisting a user in descending from a higher altitude to a lower altitude. Line-engaging device 100 may engage a bight of line, such as line 170, when side plate 106 is pivoted about pivot point 102 to an open position. Line-engaging device 100 includes closure system 180, which represents a first embodiment of a closure system. As illustrated in FIG. 2, the plurality of keepers of the closure system 180 comprise a plurality of recesses (a first recess 116, a second recess 118, and a third recess 120) in body 104 of the line-engaging device 100. FIG. 3 depicts the latch of closure system 180, which comprises a latching-cam 108. Latching-cam 108 includes a first latch 110 and a second latch 112. The first latch 110 is configured to engage the first recess 116 and the third recess 120 in when the closure system 180 is in the first and third positions, respectively. The second latch 112 is configured to engage the second recess 118 when the closure system 180 is in a second position. Engagement of the first latch 110 with the first recess 116 in the first position (also referred to herein as the fully locked position) limits or prevents movement of side plate 106 towards an open position. An actuator (not shown) physically coupled to latching-cam 108 may enable disengagement of latching-cam 108 from one or more of the plurality of recesses by inducing latching-cam 108 to pivot about pivot pin 148. In one example, the actuator may comprise a resiliently biased sliding button in an external surface of side plate 106, and may be actuated by application of a force applied by a finger of a user. Actuation of the first embodiment of the closure system from a first, locked, position, to a fourth, unlocked position, may necessarily comprise sequential actuation of the latching-cam 108 from the first position, through a second position, through a third position, and to a fourth, unlocked position. The first, second, third, and fourth positions of closure system 180 are shown in FIGS. 4A-4D. Similarly, FIGS. 5A-5D, 6A-6D, 7A-7D, and 10A-10D show the first, second, third, and fourth positions of a second, third, fourth and fifth embodiment of the closure system. FIG. 8 gives a perspective view of closure system 180, showing the actuator as resiliently biased sliding button 130. FIGS. 9A-9D give perspective views of closure system 180 being unlocked by actuation of latching-cam 108 by the actuator (sliding button 130), highlighting the relationship between sliding button 130 and latching-cam 108. Additionally, FIGS. 9A-9D depict how the position of closure system 180 may be uniquely identified based on the engagement state of the first latch 110 with the first recess 116 and/or the third recess, as indicted by first window 132 and the second window 134.

FIGS. 1-10D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation). Axis systems, such as axis system 190, may be included in one or more figures disclosed herein. The direction indicated by the arrow associated with an axis of the axis system may be referred to herein as the positive direction of that axis, while the direction opposite the direction indicated by the arrow of an axis is referred to as being in the negative direction of that axis. For example, the x-axis of axis system 190 points to the right (as viewed face on), and as such, movement in the rightward direction may be referred to as movement in the positive-x-direction, while contrastingly, movement in the leftward direction may be herein referred to as movement in the negative-x-direction. The same convention is used herein with regards to the y-axis, and the z-axis.

Turning first to FIG. 1, an example line-engaging device 100 is shown. One or more components of line-engaging device 100 are herein depicted as being partially transparent, this is to more clearly display the internal structure of line-engaging device 100, and is not intended to imply that the one or more components are limited to visually transparent materials. The line-engaging device 100 and the components described herein may be comprised of one or more of aluminum, carbon fiber, magnesium, plastics, steel, iron, or a combination thereof. Line-engaging device 100 may be a single, contiguous piece. In one example, the line-engaging device 100 comprises a plurality of components, wherein a body is a single uninterrupted piece comprising moveable components coupled thereto.

An axis system 190 comprising three axes, namely an x-axis parallel to a horizontal direction, a y-axis parallel to a vertical direction, and a z-axis perpendicular to each of the horizontal and vertical directions is shown. Arrow 192 indicates a direction of gravity. Herein, arrow 192 is referred to as gravity 192.

Line-engaging device 100 is herein depicted as a descender (herein also referred to as a rappelling device) may enable a user to descend along an anchored line from a region of higher altitude to a region of lower altitude. FIG. 1 shows line-engaging device 100 engaged with line 170, where the engagement comprises a bight of line 170 wrapping around a sheave 162 of line-engaging device 100. Line 170, as depicted in FIG. 1, is physical blocked from disengaging sheave 162 by side plate 106. In one example, line 170 may comprise a static rope. In another example, line 170 may comprise a dynamic rope. In other examples, line 170 may comprise cable or webbing. The anchor end 164 of line 170 extends upwards (in the positive y-direction) to an anchor point, while the free end 150 of line 170 extends downwards in the direction of gravity 192 to an area at an altitude lower than the anchor. Line 170 may be anchored by any method known in the art of line work. In one example, line 170 may be anchored by connecting line 170 to an anchor, the anchor comprising carabiners clipped to bolts, the bolts embedded within a wall or rock face. Anchor end 164 of line 170 may be connected to the anchor by inserting a bight of line 170 through a gate of one or more carabiners of the anchor, wherein the carabiners are clipped to a chain or bolt securely fastened to a stationary object. In another example, line 170 may be anchored by attaching anchor end 164 of line 170 directly to an object, such as a concrete column, metal railing, a tree, or other stationary objects which may support the weight of a user. In one example line-engaging device 100 may enable a user to rappel down a rock face along anchored line 170, where the line 170 may be anchored at an anchor end 164 at a higher point on the rock face while a free end 150 of line 170 may extend downwards to a lower point on the rock face. The user may couple line-engaging device 100 to a harness (not shown) by inserting a carabiner through attachment point 140 of the line-engaging device 100 and through a loop of the harness. Coupling a harness worn by the user to line-engaging device 100 enables the weight of the user to act on line-engaging device 100, this downward force being countered by friction applied by line engaging device 100 onto line 170. Reduction of the amount of friction exerted on line 170 by line-engaging device 100 may enable the user to descend in the direction of gravity 192 by allowing line 170 to slide through line-engaging device 100. In this way, the user may descend the rock face by feeding line 170 through device 100, enabling device 100, and the user coupled thereto, to move downwards (in the negative y-direction) along line 170 towards the ground. In one example, a rate of descent of the user along line 170 may be controlled by adjusting an amount of friction applied to line 170. The amount of friction applied to line 170 by line-engaging device 100 may be user adjustable, such that the user may control the rate of descent by changing the orientation of the line-engaging device 100 relative to line 170, or by actuating device 100 to apply a greater or lesser friction onto line 170. In one example, the amount of friction applied to line 170 by line-engaging device 100 is controlled by adjusting the size of a passage in device 100 through which line 170 passes. In another example, line-engaging device 100 may enable a user to descend line 170 from a window or roof of a building to the ground, such as may occur in urban rescue work.

Line-engaging device 100 comprises a body 104, and a side plate 106 pivotally coupled thereto. The side plate 106 is pivotally coupled to body 104 via side plate pivot point 102. In one example, side plate pivot point 102 may comprise a side plate pivot pin inserted into a side plate pivot pin receiving hole which enables rotation of side plate 106 about a central axis of the side plate pivot pin. The axis of rotation of the pivot point 102 extends substantially parallel to the z-axis, with the plane of rotation of the side plate 106 about pivot point 102 being substantially parallel to the xy-plane. In one example, side plate pivot point 102 may be a cylindrical pin with ends flared in the xy-plane, such that a diameter of the cylindrical pin is greater at the terminal ends of the pin than in a middle region of the pin, wherein the middle region of the pin passes through the side plate pivot pin receiving hole in the side plate 106 and body 104. In another example, the side plate pivot point 102 comprises a cylindrical pin with terminal ends of a diameter greater than a diameter of the side plate pivot pin receiving hole through the side plate 106 and body 104, wherein a middle region of the cylindrical pin is of a smaller diameter than the cylindrical pin receiving hole passing through the side plate 106 and body 104, thereby substantially limiting movement of side plate 106 relative to body 104 in the z-direction, while enabling rotation of side plate 106 relative to body 104 in the xy-plane. Clockwise rotation of the side plate 106 about the side plate pivot point 102 to an open position exposes sheave 162, and enables line 170 to be engaged or disengaged with device 100. In other embodiments, line-engaging device 100 may engage with line 170 via a line engaging groove or channel which disallows disengagement of line 170 while side plate 106 is in a closed position.

Rotation of side plate 106 about side plate pivot point 102 is physically limited by side plate stop 142, which contacts and prevents further rotation of side plat 106. Thus, side plate stop 142 prevents full 360° rotation of side plate 106 about side plate pivot point 102. In one example, side plate stop 142 prevents additional clockwise rotation of the side plate 106 while the side plate 106 is in an open position. In another example, side plate stop 142 prevents further anti-clockwise rotation of the side plate 106 about side plate pivot point 102 while the side plate 106 is in a closed position (as shown in FIG. 1). In another example side plate stop 142 limits the rotational freedom of side plate 106 to 270°, wherein the closed position corresponds to 0° (the position of the side plate 106 as depicted in FIG. 1) and the open position corresponds to 270°. Side plate stop 142 may comprise a protrusion of body 104 into the plane defined by rotation of side plate 106 about side plate pivot point 102. While side plate 106 is in an open position, wherein sheave 162 is exposed, sheave 162 may engage with a bight of line by wrapping the bight of line around the sheave 162. In the closed position, the inner surface of side plate 106 and an outer surface of sheave 162 may be flush, or substantially closer than the diameter of line 170, wherein the inner surface of side plate 106 is the portion of side plate 106 facing body 104, and the outer surface of sheave 162 is the surface substantially parallel to the xy-plane extended most towards the negative z-direction. In one example, sheave 162 may be pivotally coupled to the body 104 of device 100. In another example, sheave 162 may comprise a groove or path formed by protrusions of body 104, and thus may be of a single piece with body 104, and therefore not pivotable relative to body 104. Sheave 162 may be substantially circular. In another example, sheave 162 may be oblong. In yet another example, sheave 162 may be of polygonal shape. In other examples, line-engaging device 100 may engage with line 170 by insertion of line 170 into tortuous grooves or paths of various geometries, such as s-shaped.

As shown in FIG. 1, attachment point 140 comprises an oblong passage through body 104. Attachment point 140 may be configured to receive a carabiner. In one example, attachment point 140 may be a circular, or polygonal passage or ring formed in body 104. In another example, attachment point 140 may be configured to swivel relative to body 104 about an axis of rotation, the axis of rotation being substantially parallel to the y-axis. Attachment point 140 may enable coupling of device 100 to a harness by a user by inserting a carabiner through attachment point 140 and a loop of the harness. In another example, attachment point 140 may enable attachment of a hook. In yet another example, device 100 may comprise more than 1 attachment point, such that multiple harnesses or loads may be coupled to device 100.

Line-engaging device 100 includes closure system 180, which represents a first embodiment of a closure system for securing, or locking, side plate 106 in the closed position, thereby securing an engaged line. Closure system 180 comprises a latch, a plurality of keepers for engaging with the latch, and an actuator for actuating the latch to disengage the plurality of keepers thereby enabling closure system 180 to transition from a locked position to an unlocked position.

The plurality of keepers of closure system 180 comprise a plurality of recesses in body 104, which includes a first recess 116, a second recess 118, and a third recess 120. The first recess 116 and third recess 120 are located in a first plane and configured to engage with the first latch 110 of the latching-cam 108, while the second recess 118 is located in a second plane and configured to engaged with the second latch 112 of the latching-cam, wherein the first and second planes are substantially parallel to the xy-plane with the first plane nearer to side plate 106 along the z-axis and with the second plane positioned further away from side plate 106 along the z-axis. The first recess 116 and the third recess 118 do not intersect with the second plane, and likewise, the second recess 118 does not intersect with the first plane. The first plane and second plane may be parallel, non-intersecting planes. The first plane is located nearer side plate 106, while the second plane is located further away from the side plate 106. As shown in FIG. 1, the second recess 118 and the third recess 120 appear to overlap as viewed along a line of sight parallel to the z-axis. One of the advantages enabled by the current disclosure is that by positioning the plurality of keepers in first and second non-intersecting planes, as shown in FIG. 1, a more compact arrangement (with respect to the x-axis) of closure system 180 may be achieved than would be possible if the plurality of keepers occupied a single plane. The first recess 116, second recess 118, and third recess 120 comprise recesses, indentations, or grooves made within a body 104, for engaging the first latch 110 and second latch 112 of the latching-cam 108, and as such may be sized such that the first latch 110 and/or second latch 112 may be snuggly inserted therein. In other embodiments, the plurality of keepers may comprise one or more raised features or protrusions configured to engage with, and inhibit motion of, latching-cam 108. First recess 116 comprises first latch-catch 128, which is configured to catch and engage the first latch 110 of latching-cam 108 when the closure system 180 is in a first position (such as the position shown in FIG. 1). Engagement of the first latch 110 with first latch-catch 128 comprises mating of geometrically complementary features of the first latch 110 and the first latch-catch 128 arresting movement of the first latch 110 in substantially the x-direction (and thereby arresting movement of the side plate 106 coupled thereto). The first latch 110 may disengage with the first latch-catch 128 upon actuation in the y-direction, such as by pivoting latching-cam 108 in an anti-clockwise manner. First latch-catch 128 may comprise an angled surface, which may interact with a similarly angled surface of the latch. In other examples latch-catch 128 may comprise a hook. Engagement of the first latch 110 and first latch-catch 128 may prevent or inhibit rotation of side plate 106 in a clockwise direction, while permitting disengagement of the first latch 110 from latch-catch 128 by actuation of latching-cam 108 by action of an actuator.

The second recess 118 likewise comprises a second latch-catch 126, for engaging and arresting motion of the second latch 112 of latching-cam 108. Second latch-catch 126 may prevent side plate 106 from rotating in a clockwise direction about side plate pivot point 102 (towards the open position) by engaging second latch 112 through mating of complimentary features of second latch 112 and second latch catch 126. Engagement of second latch catch 126 with second latch 112 may inhibit movement of the second latch 112 in the negative-x-direction (towards the unlocked position), while permitting movement of the second latch 112 in the positive-x-direction (towards the locked position). Said another way, latch catch 126 may engage with second latch 112 and prevent motion of side plate 106 towards an open position, but may not inhibit motion of side plate 106 towards the fully closed position. In one example, while second latch catch 126 and second latch 112 are engaged, further movement of side plate 106 towards the open position (clockwise rotation about side plate pivot point 102) may require disengagement of the second latch catch 126 from the second latch 112 by actuation of an actuator. In another example, while second latch catch 126 and second latch 112 are engaged, movement of side plate 106 towards the closed position (anti-clockwise rotation about side plate pivot point 102) may not require actuation of an actuator, and may be accomplished by pressing side plate 106 towards the closed position. In one example, the side of second recess 118 opposite second latch catch 126 may comprise an angled surface for enabling egress of second latch 112 from second recess 118. The shape or method of engagement of the second latch catch 126 may be different than the shape or method of engagement of the first latch catch 128, as the first latch 110 and second latch 112 may likewise be of different shapes.

The third recess 120 likewise comprises a third latch-catch 124, for engaging and arresting motion of the first latch 110 of latching-cam 108. Third latch-catch 124 may prevent side plate 106 from rotating in a clockwise direction about side plate pivot point 102 (towards the open position) by engaging first latch 110 through mating of complimentary features of first latch 110 and third latch catch 124. Engagement of third latch catch 124 with first latch 110 may inhibit movement of the first latch 110 in the negative-x-direction (towards the unlocked position), while permitting movement of the first latch 110 in the positive-x-direction (towards the locked position). Said another way, third latch catch 124 may engage with first latch 110 and prevent motion of side plate 106 towards an open position, but may not inhibit motion of side plate 106 towards the fully closed position. In one example, while third latch catch 124 and first latch 110 are engaged, further movement of side plate 106 towards the open position (clockwise rotation about side plate pivot point 102) may require disengagement of the third latch catch 124 from the first latch 110 by actuation of an actuator. In another example, while third latch catch 124 and first latch 110 are engaged, movement of side plate 106 towards the closed position (anti-clockwise rotation about side plate pivot point 102) may not require actuation of an actuator, and may be accomplished by pressing side plate 106 towards the closed position. In one example, the side of third recess 120 opposite third latch catch 124 may comprise an angled surface for enabling egress of first latch 110 from third recess 120.

In the embodiment shown by FIG. 1, the latch of closure system 180 comprises a latching-cam 108. Latching-cam 108 includes a first latch 110 in a first plane and a second latch 112 in a second plane, the first latch 110 not intersecting with the second plane, and likewise, the second latch 112 not intersecting with the first plane. First latch 110 and second latch 112 protruding from a latching-cam body 146 on opposite sides of pivot pin receiving hole 114. First latch 110 may be configured to engage with the first recess 116 and third recess 120 also located in the first plane, and the second latch 112 may be configured to engage with second recess 118 located in the second plane. Latching-cam 108 is pivotally mounted to side plate 106 via a pivot pin 148 which is mechanically coupled to side plate 106 and inserted through pivot pin receiving hole 114. Pivot pin 148 may enable rotation of latching-cam 108 about pivot pin 148. In one example pivot pin 148 couples latching-cam 108 to side plate 106 and substantially prevents movement of latching-cam 108 in the z-direction. In another example, an outer diameter of pivot pin 148 is less than the diameter of pivot pin receiving hole 114, thereby enabling latching-cam 108 to rotate (or pivot) about pivot pin 148.

By providing first recess 116, second recess 118, and third recess 120, which engage latching-cam 108 in a first position, a second position, and a third position, a probability of unintended unlocking of closure system 180 may be reduced. In one example, by configuring the second recess 118 and the third recess 120, such that latching-cam 108 necessarily engages with the second recess 118 and the third recess 120 as closure system 180 moves from a first (fully locked) position, to a fourth (fully unlocked position), ensures that at least two actuations of an actuator are necessary to unlock closure system 180, thereby reducing the probability that a single unintended actuation of the actuator unlocks closure system 180.

Turning to FIG. 2, an alternate view of the first embodiment of closure system 180 is depicted. Elements which were previously introduced have retained the same numbering in FIG. 2. FIG. 2 more clearly illustrates the configuration of the first recess 116, the second recess 118, and the third recess 120. An axis system 290 comprising three axes, namely an x-axis parallel to a horizontal direction, a y-axis parallel to a vertical direction, and a z-axis perpendicular to each of the horizontal and vertical directions is shown. The arrangement of the first recess 116 and third recess 120 in a first plane, and the second recess 118 in a second plane, more clearly distinguished. A first window 132 in a side wall of the first recess 116, for visually indicating engagement of the first latch 110 with the first recess 116 is depicted. First window 132 is herein depicted as a substantially rectangular passage through body 104, leading from inside first recess 116 to an external surface of body 104, and permitting the passage of light therethrough. In one example, the first window 132 may enable light to pass into first recess 116 from outside of line-engaging device 100, reflect off of first latch 110 engaged therein, and pass back out through first window 132 to an eye of a user, thereby indicating engagement of first latch 110 with first recess 116. In a second example light may pass into first recess 116 from outside of line-engaging device 100, reflect off of the walls defining first recess 116, and pass exit first recess 116 through first window 132, thereby indicating that first latch 110 is not engaged with first recess 116. Similarly, second window 134, comprising a substantially rectangular passage through body 104 of a side wall of third recess 120, may visually indicate engagement of first latch 110 with third recess 120. In one example, second window 134 may enable light to pass into third recess 120 from outside of line-engaging device 100, reflect off of first latch 110 engaged therein, and pass back out through second window 134 to an eye of a user, thereby indicating engagement of first latch 110 with third recess 120. In a second example light may pass into third recess 120 from outside of line-engaging device 100, reflect off of the walls defining third recess 120, and exit third recess 120 through second window 134, thereby indicating that first latch 110 is not engaged with third recess 120.

Turning to FIG. 3, an alternate view of of latching-cam 108 is depicted. Elements which were previously introduced have retained the same numbering in FIG. 3. An axis system 390 comprising three axes, namely an x-axis parallel to a horizontal direction, a y-axis parallel to a vertical direction, and a z-axis perpendicular to each of the horizontal and vertical directions is shown. Latching-cam 108 comprises latching-cam body 146, from which first latch 110, and second latch 112, protrude. The first latch 110 and second latch 112 comprise protrusions or teeth of latching-cam body 146, and include one or more surfaces for engaging with a latch catch in one or more of a plurality of recesses. The first latch 110 includes a curved (or hook like) surface for engaging with one or more of the plurality of recesses of closure system 180, while the second latch 112 includes a rounded surface for engaging with engaging with one or more recesses of closure system 180. A pivot pin receiving hole 114 comprising a cylindrical passage through latching-cam body 146 is positioned between first latch 110 and second latch 112. The pivot pin receiving hole 114 is configured to receive pivot pin 148. Latching-cam body 146 may be pivotally coupled to side plate 106 by engagement of pivot pin 148 with pivot pin receiving hole 114. FIG. 4 highlights that first latch 110 occupies a first plane, and that second latch 112 occupies a second plane, and that the first and second planes do not intersect.

Figure 4A:
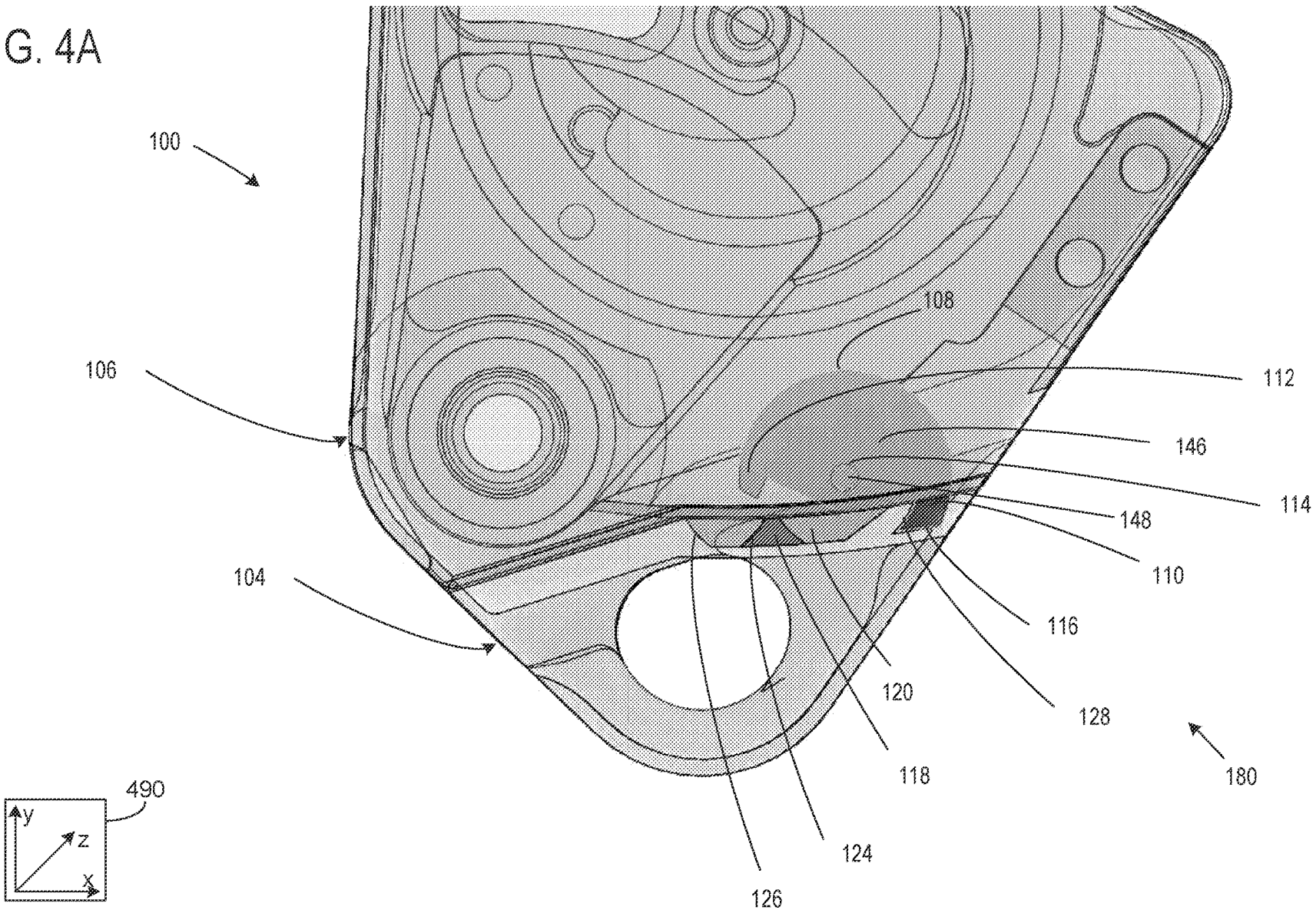
FIGS. 4A, 4B, 4C, and 4D show the first embodiment of the closure system being actuated from a locked position to an unlocked position.
Figure 4B:
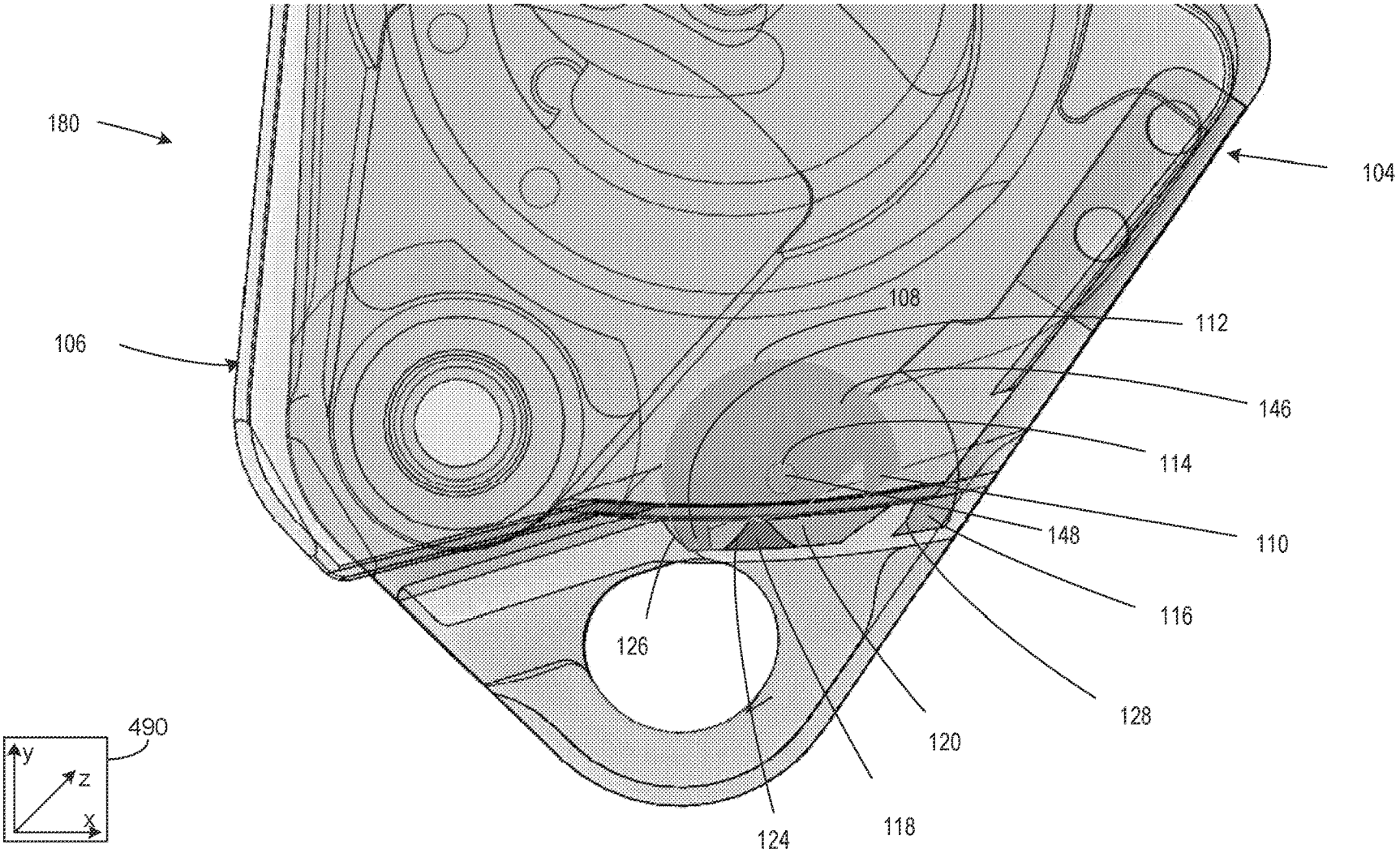
Figure 4C:
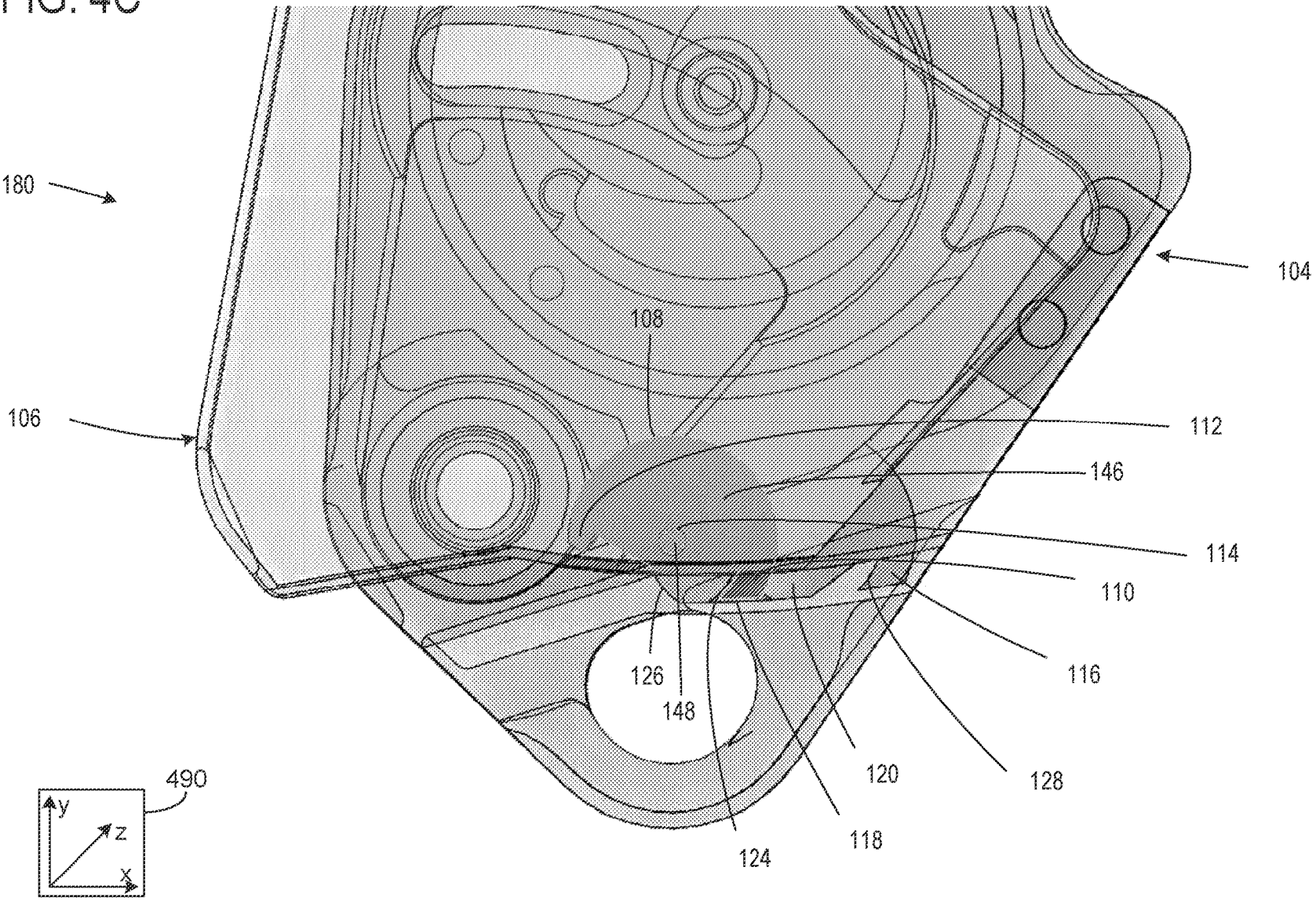
Figure 4D:
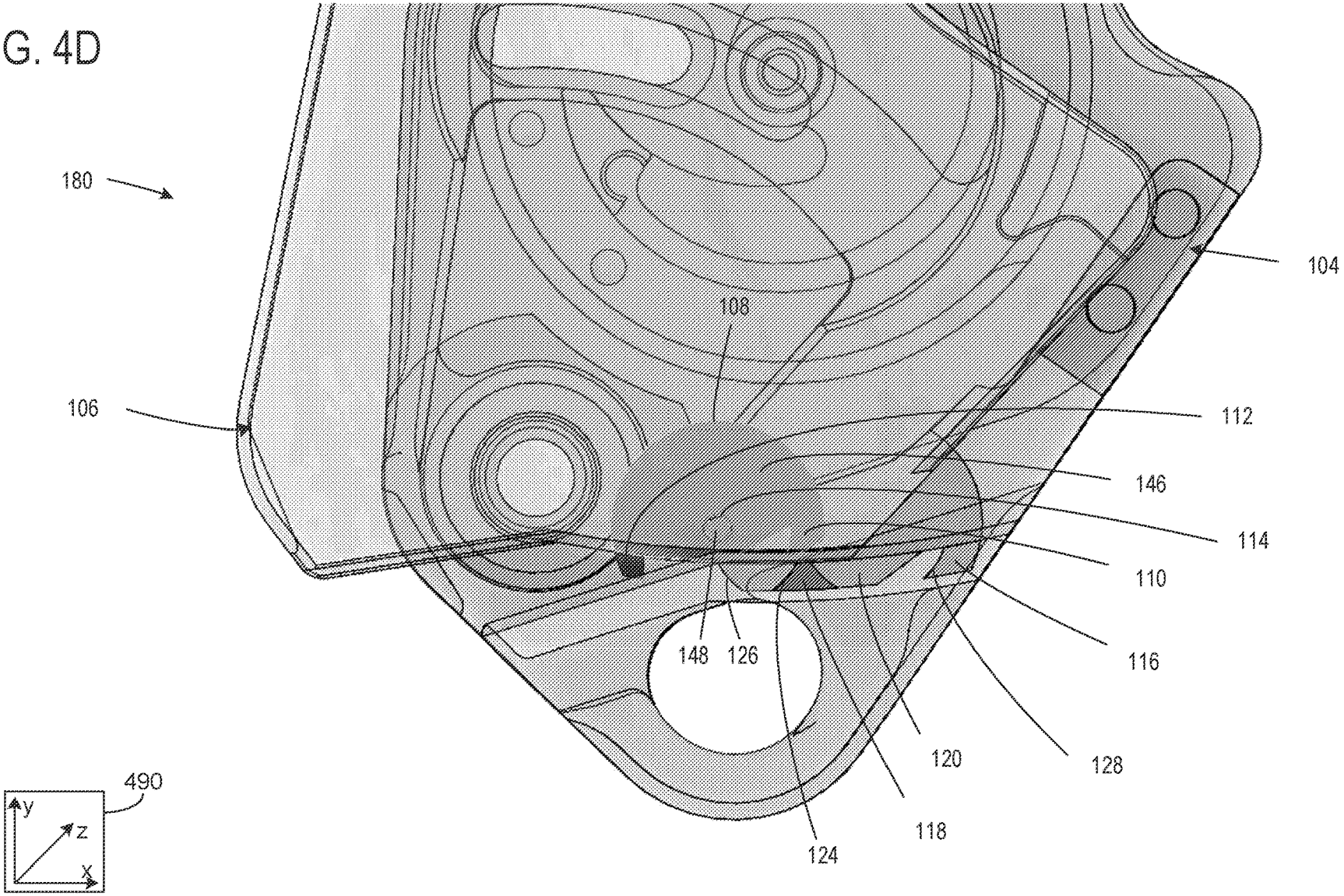

FIGS. 4A-4D depict closure system 180 transitioning from a first, fully locked, position to a fourth, unlocked, position by sequentially moving from the first position (FIG. 4A), to the second position (FIG. 4B), then to the third position (FIG. 4C), and finally to the fourth, unlocked, position (FIG. 4D). In order to show the internal components of closure system 180, while also illustrating the position of side plate 106, side plate 106 is depicted as transparent, however, it will be appreciated that this is for illustrative purposes and does not limit the invention to implementations in which side plate 106 is transparent. Elements which were previously introduced have retained the same numbering in FIGS. 4A-4D. FIGS. 4A-4D include axis system 490 comprising three axes, namely an x-axis parallel to a horizontal direction, a y-axis parallel to a vertical direction, and a z-axis perpendicular to each of the horizontal and vertical directions. The plurality of keepers of closure system 180 comprise the first recess 116, the second recess 118, and the third recess 120, while the latch of closure system 180 comprises latching-cam 108. A novel aspect of closure system 180 is the arrangement of the first recess 116, second recess 118, and third recess 120 relative to latching-cam 108, which prevents closure system 180 from transitioning from the first, fully locked, position, to the fourth unlocked position in a single actuation. In this way, the probability of unintentionally unlocking closure system 180 is reduced, and thereby the probability of unintentionally disengaging a line from line-engaging device 100 may be reduced.

Turning to FIG. 4A, closure system 180 is depicted in the first position, wherein the first latch 110 is engaged with the first recess 116. In the first position, the first latch 110 may engage with the first recess 116 by interaction of complementary geometries of the first latch catch 128 and the first latch 110. As depicted in FIG. 4A, the complementary geometry of first latch 110 and first latch catch 128 comprises correspondingly angled surfaces, wherein the first latch 110 in a primary position (as shown in FIG. 4A) is flush with first latch catch 128. Applying a force to side plate 106 in a direction of the open position (towards the left as depicted in FIG. 4A), will be resisted by contact of first latch 110 with first latch catch 128, thereby preventing movement of side plate 106 towards the open position while first latch 110 and first recess 116 are engaged. Disengaging first latch 110 from the first latch catch 128 may occur by actuating latching-cam 108 to pivot about pivot pin 148 from a primary position to a secondary position, such that first latch 110 moves substantially upwards (in the positive-y-direction) and second latch 112 moves substantially downwards (in the negative-y-direction), inducing first latch 110 to slide out of first recess 116, while second latch 112 enters into second recess 118. Side plate 106 may then be actuated towards the open position until second latch 112 engages with second latch catch 126, thereby arresting the movement of side plate 106. In this way, closure system 180 may transition from the first position to the second position.

Turning to FIG. 4B, closure system 180 is depicted in the second position, wherein the second latch 112 is engaged with the second recess 118. In the second position, the second latch 112 may engage with the second recess 118 by interaction of complementary geometries of the second latch catch 126 and the second latch 112. As depicted in FIG. 4B, the complementary geometry of second latch 112 and second latch catch 126 comprises correspondingly curved surfaces, wherein while latching-cam 108 is in its secondary position (the angular position of latching 108 relative to pivot pin 148 depicted in FIG. 4B) second latch 112 may be flush with second latch catch 126. Applying a force to side plate 106 in a direction of the open position (towards the left as depicted in FIG. 4B), will be resisted by contact of second latch 112 with second latch catch 126, thereby preventing movement of side plate 106 towards the open position while second latch 112 and second recess 118 are engaged. Disengaging second latch 112 from the second latch catch 126 may occur by actuating latching-cam 108 to pivot about pivot pin 148 from the secondary position to the primary position, such that second latch 112 moves substantially upwards (in the positive-y-direction) and first latch 110 moves substantially downwards (in the negative-y-direction), inducing second latch 112 to slide out of second recess 118, while first latch 110 enters into third recess 120. Side plate 106 may then be actuated towards the open position until first latch 110 engages with third latch catch 124, thereby arresting the movement of side plate 106 towards the open position. In this way, closure system 180 may transition from the second position to the third position.

Turning to FIG. 4C, closure system 180 is depicted in the third position, wherein the first latch 110 is engaged with the third recess 120. In the third position, the first latch 110 may engage with the third recess 120 by interaction of complementary geometries of the third latch catch 124 and the first latch 110. As depicted in FIG. 4C, the complementary geometry of first latch 110 and third latch catch 124 comprises correspondingly angled surfaces, wherein while latching-cam 108 is in its primary position (the angular position of latching 108 relative to pivot pin 148 depicted in FIG. 4C) first latch 110 may be flush with third latch catch 124. Applying a force to side plate 106 in a direction of the open position (towards the left as depicted in FIG. 4B), will be resisted by contact of first latch 110 with third latch catch 124, thereby preventing movement of side plate 106 towards the open position while first latch 110 and third recess 120 are engaged. Disengaging first latch 110 from the third latch catch 124 may occur by actuating latching-cam 108 to pivot about pivot pin 148 from the primary position to the secondary position, such that first latch 110 moves substantially upwards (in the positive-y-direction) and second latch 112 moves substantially downwards (in the negative-y-direction), inducing first latch 110 to slide out of third recess 120. Side plate 106 may then be actuated towards the open position. In this way, closure system 180 may transition from the third position to the fourth position.

Turning to FIG. 4D, closure system 180 is depicted in the fourth, unlocked position, wherein the first latch 110 and second latch 112 are not engaged with any of the plurality of keepers (recesses) of closure system 180. Side plate 106 may be actuated towards the open position, and a bight of line may be engaged or disengaged with line-engaging device 100.

Figure 5A:
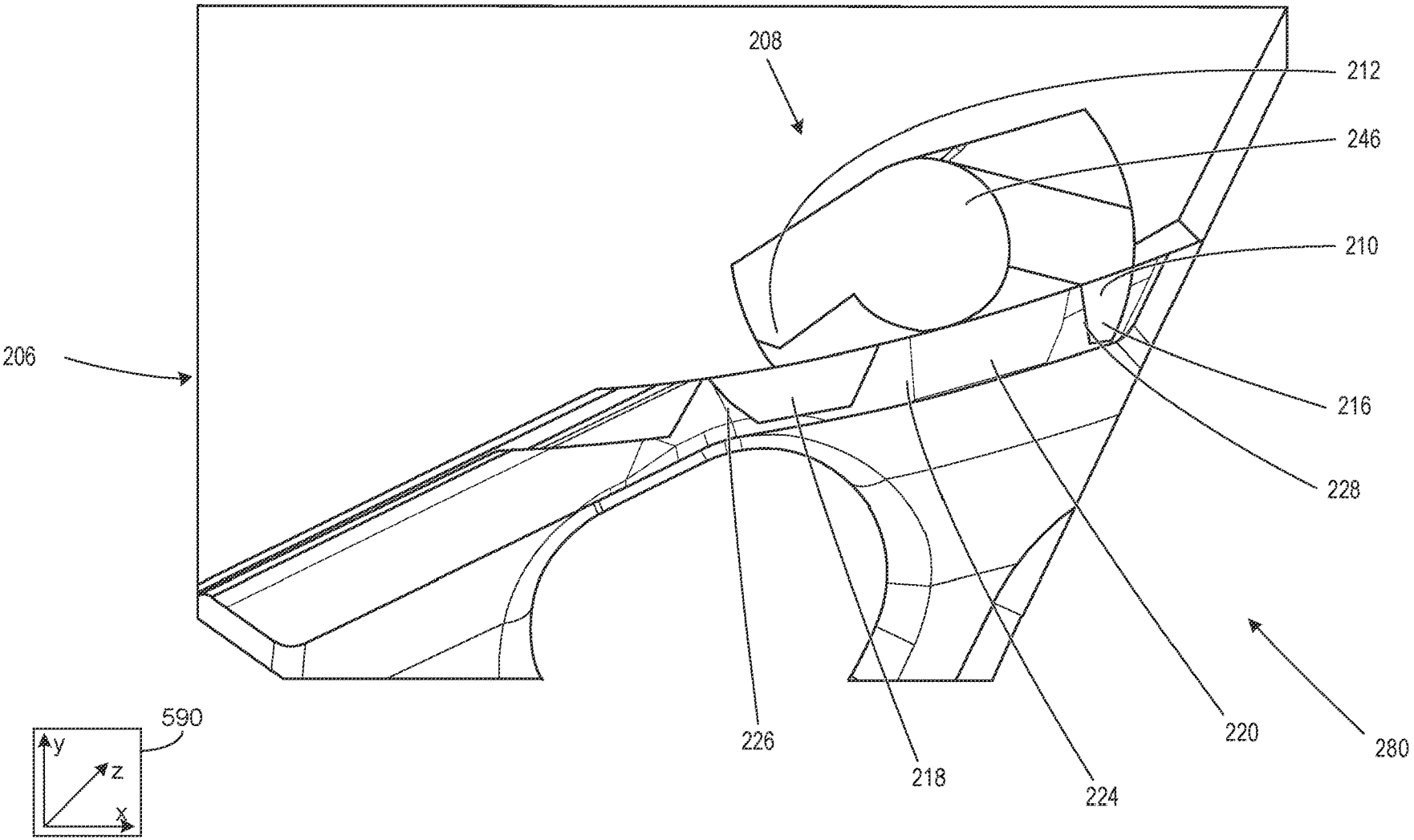
FIGS. 5A, 5B, 5C, and 5D show a second embodiment of the closure system being actuated from a locked position to an unlocked position.
Figure 5B:
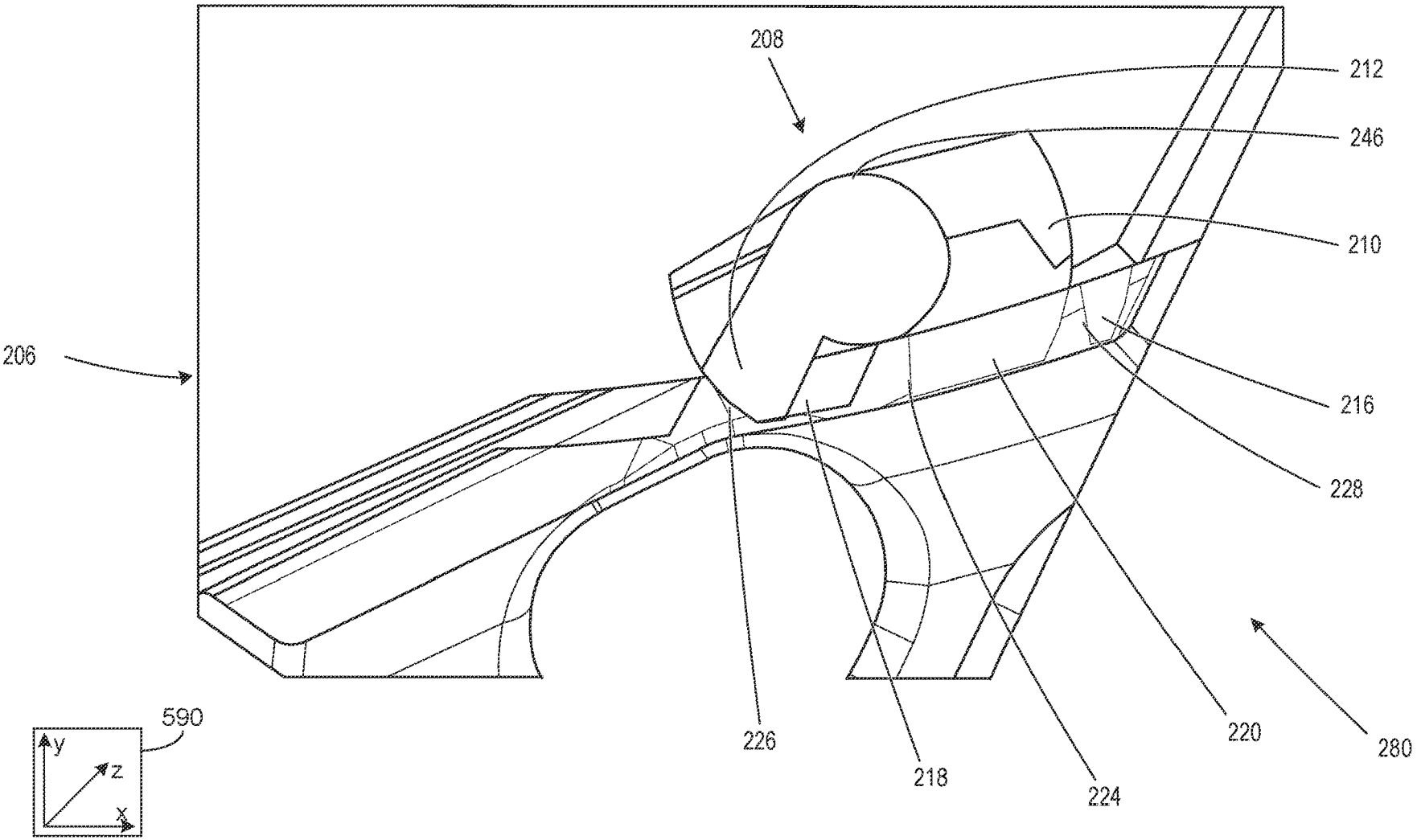
Figure 5C:
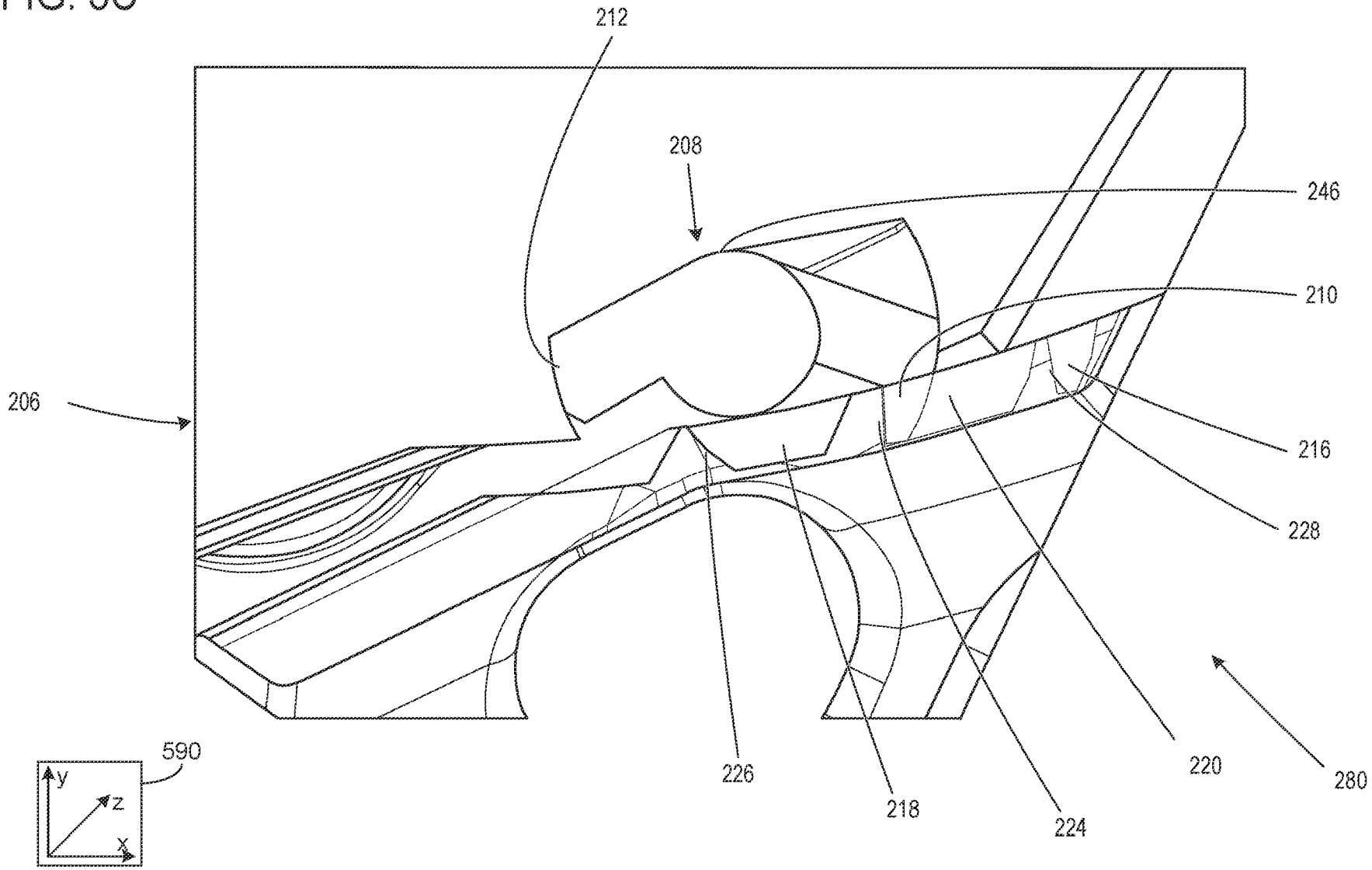
Figure 5D:
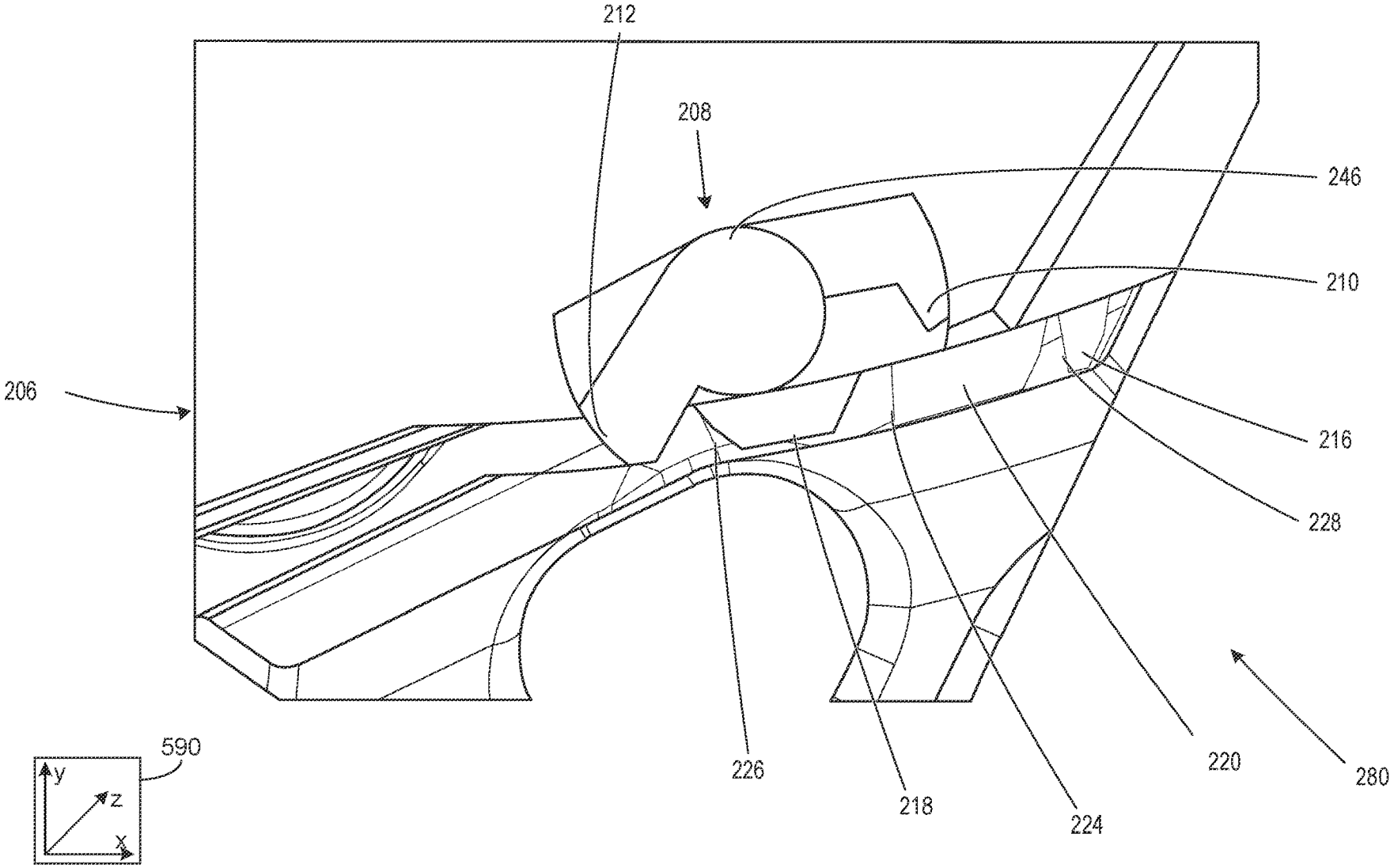

FIGS. 5A-5D depict a second embodiment of a closure system, closure system 280, transitioning from a first, fully locked, position to a fourth, unlocked, position by sequentially moving from the first position (FIG. 5A), to the second position (FIG. 5B), then to the third position (FIG. 5C), and finally to the fourth, unlocked, position (FIG. 5D). In order to show the internal components of closure system 280, while also illustrating the position of side plate 206, side plate 206 is depicted as transparent, however, it will be appreciated that this is for illustrative purposes and does not limit the invention to implementations in which side plate 206 is transparent. FIGS. 5A-5D include axis system 590 comprising three axes, namely an x-axis parallel to a horizontal direction, a y-axis parallel to a vertical direction, and a z-axis perpendicular to each of the horizontal and vertical directions. The plurality of keepers of closure system 280 comprise a first recess 216, a second recess 218, and a third recess 220, while the latch of closure system 280 comprises latching-cam 208. Latching-cam 208 comprises a first latch 210 and a second latch 212 which protrude from latching-cam body 246. The first latch 210, the first recess 216, and the third recess 220 may occupy a first plane, while the second latch 212, and the second recess 218, may occupy a second plane, wherein the first plane and the second plane are non-intersecting planes. The first latch 210 and the second latch 212 of closure system 280 each comprise a first and second substantially planar surface, an angle between these planar surfaces corresponding to an angle between a first and second planar surface of the first recess 216, the second recess 218, or the third recess 220. In one example, engagement of first latch 210 with first recess 216 comprises the first and second planar surfaces of first latch 210 laying flush with the first and second planar surfaces of first recess 216.

Turning to FIG. 5A, closure system 280 is depicted in the first position, wherein the first latch 210 is engaged with the first recess 216. In the first position, the first latch 210 may engage with the first recess 216 by interaction of complementary geometries of the first latch catch 228 and the first latch 210. As depicted in FIG. 5A, the complementary geometry of first latch 210 and first latch catch 228 comprises correspondingly angled surfaces, wherein the first latch 210 in a primary position (as shown in FIG. 5A) is flush with first latch catch 228. Applying a force to side plate 206 in a direction of the open position (towards the left as depicted in FIG. 5A), will be resisted by contact of first latch 210 with first latch catch 228, thereby preventing movement of side plate 206 towards the open position while first latch 210 and first recess 216 are engaged. Disengaging first latch 210 from the first latch catch 228 may occur by actuating latching-cam 208 to pivot about a pivot point located (not shown) from a primary position to a secondary position, such that first latch 110 moves substantially upwards (in the positive-y-direction) and second latch 212 moves substantially downwards (in the negative-y-direction), inducing first latch 210 to slide out of first recess 216, while second latch 212 enters into second recess 218. Side plate 206 may then be actuated towards the open position until second latch 212 engages with second latch catch 226, thereby arresting the movement of side plate 206. In this way, closure system 280 may transition from the first position to the second position.

Turning to FIG. 5B, closure system 280 is depicted in the second position, wherein the second latch 212 is engaged with the second recess 218. In the second position, the second latch 212 may engage with the second recess 218 by interaction of complementary geometries of the second latch catch 226 and the second latch 212. As depicted in FIG. 5B, the complementary geometry of second latch 212 and second latch catch 226 comprises correspondingly curved surfaces, wherein while latching-cam 208 is in its secondary position (the angular position of latching 208 relative to the pivot point, not shown, depicted in FIG. 5B) second latch 212 may be flush with second latch catch 226. Applying a force to side plate 206 in a direction of the open position (towards the left as depicted in FIG. 5B), may be resisted by contact of second latch 212 with second latch catch 226, thereby preventing movement of side plate 206 towards the open position while second latch 212 and second recess 218 are engaged. Disengaging second latch 212 from the second latch catch 226 may occur by actuating latching-cam 208 to pivot about the pivot point (not shown) from the secondary position to the primary position, such that second latch 212 moves substantially upwards (in the positive-y-direction) and first latch 210 moves substantially downwards (in the negative-y-direction), inducing second latch 212 to slide out of second recess 218, while first latch 210 enters into third recess 220. Side plate 206 may then be actuated towards the open position until first latch 210 engages with third latch catch 224, thereby arresting the movement of side plate 206 towards the open position. In this way, closure system 280 may transition from the second position to the third position.

Turning to FIG. 5C, closure system 280 is depicted in the third position, wherein the first latch 210 is engaged with the third recess 220. In the third position, the first latch 210 may engage with the third recess 220 by interaction of complementary geometries of the third latch catch 224 and the first latch 210. As depicted in FIG. 5C, the complementary geometry of first latch 210 and third latch catch 224 comprises correspondingly angled surfaces, wherein while latching-cam 208 is in its primary position (the angular position of latching 208 relative to the pivot point, as depicted in FIG. 5C) first latch 210 may be flush with third latch catch 224. Applying a force to side plate 206 in a direction of the open position (towards the left as depicted in FIG. 5B), will be resisted by contact of first latch 210 with third latch catch 224, thereby preventing movement of side plate 206 towards the open position while first latch 210 and third recess 220 are engaged. Disengaging first latch 210 from the third latch catch 224 may occur by actuating latching-cam 208 to pivot about pivot pin 248 from the primary position to the secondary position, such that first latch 210 moves substantially upwards (in the positive-y-direction) and second latch 212 moves substantially downwards (in the negative-y-direction), inducing first latch 210 to slide out of third recess 220. Side plate 206 may then be actuated towards the open position. In this way, closure system 280 may transition from the third position to the fourth position.

Turning to FIG. 5D, closure system 280 is depicted in the fourth, unlocked position, wherein the first latch 210 and second latch 212 are not engaged with any of the plurality of keepers (recesses) of closure system 280. Side plate 206 may be actuated towards the open position.

Figure 6A:
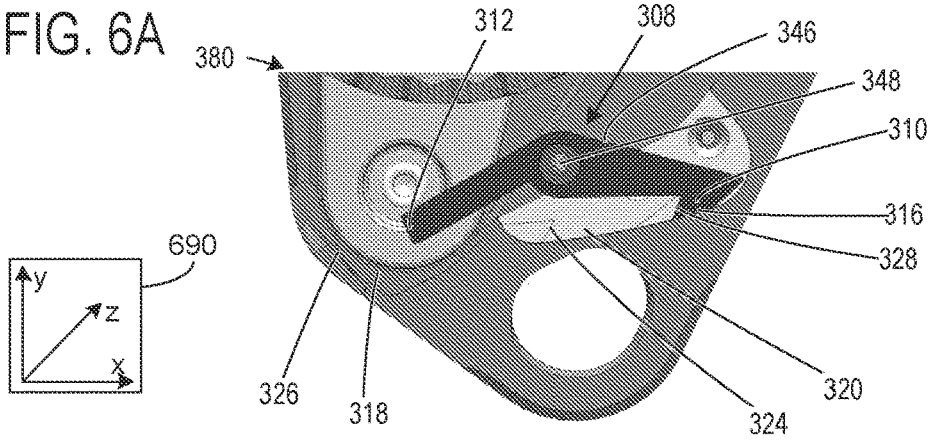
FIGS. 6A, 6B, 6C, and 6D show a third embodiment of the closure system being actuated from a locked position to an unlocked position.
Figure 6B:
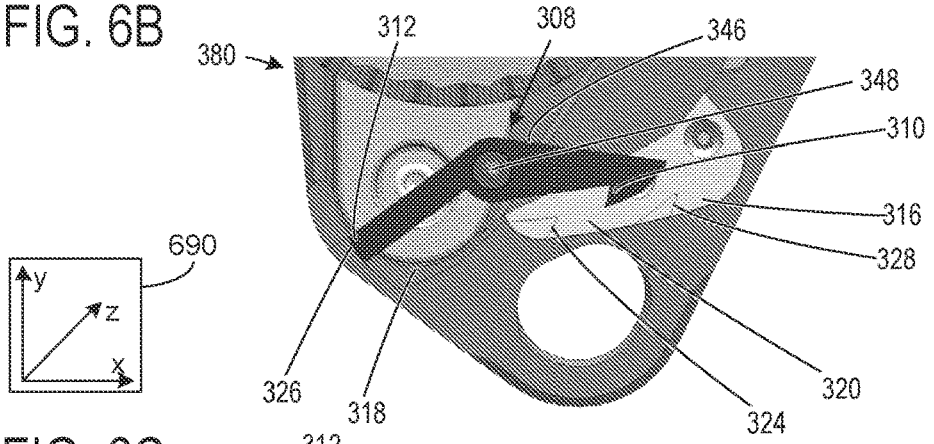
Figure 6C:
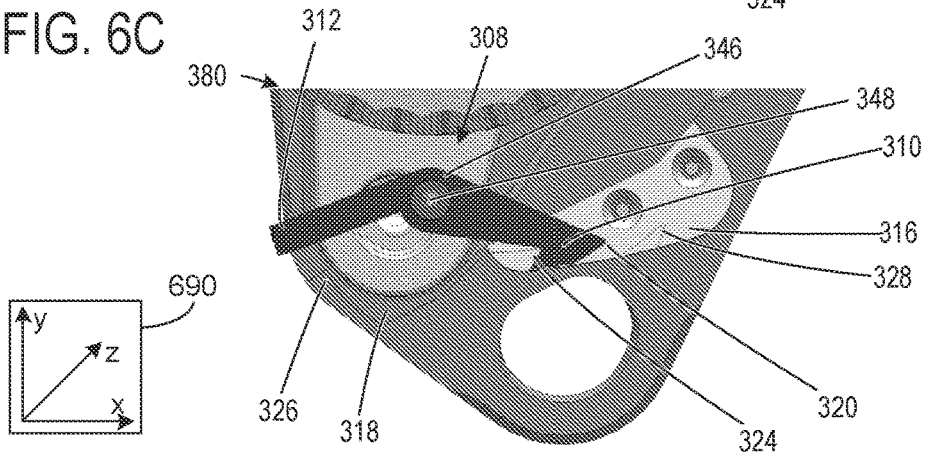
Figure 6D:
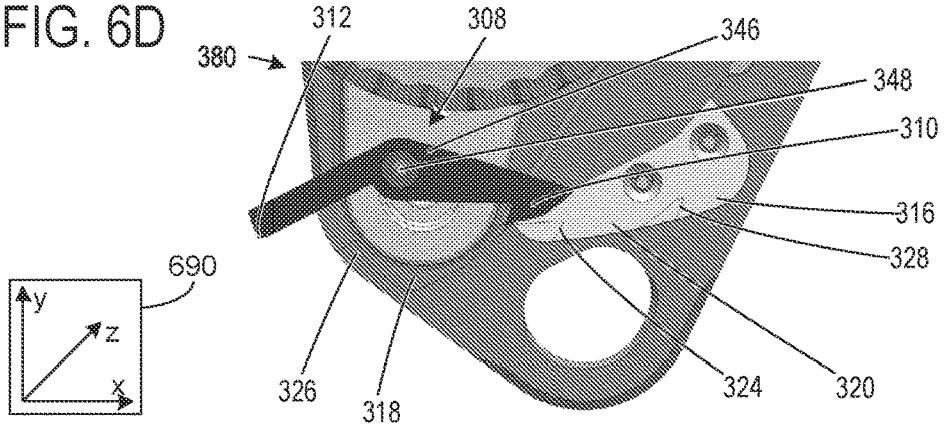

FIGS. 6A-6D depict a third embodiment of a closure system, closure system 380, transitioning from a first, fully locked, position to a fourth, unlocked, position by sequentially moving from the first position (FIG. 6A), to the second position (FIG. 6B), then to the third position (FIG. 6C), and finally to the fourth, unlocked, position (FIG. 6D). In order to show the internal components of closure system 380, the side plate of closure system 380 is not shown, however it will be appreciated that latching-cam 308 is pivotally coupled to the side plate of closure system 380. FIGS. 6A-6D include axis system 690 comprising three axes, namely an x-axis parallel to a horizontal direction, a y-axis parallel to a vertical direction, and a z-axis perpendicular to each of the horizontal and vertical directions. The plurality of keepers of closure system 380 comprise a first recess 316, a second recess 318, and a third recess 320, while the latch of closure system 380 comprises latching-cam 308. Latching-cam 308 comprises a first latch 310 and a second latch 312 which protrude from latching-cam body 346. First latch 310 comprises an angular hook-like feature, which may engage with the first recess 316 and the third recess 320. Second latch 312 comprises a substantially planar feature, which may engage with a substantially planar feature of second recess 318, and may only disengaged second recess 318 by passing through an opening, or passage, of second recess 318.

Turning to FIG. 6A, closure system 380 is depicted in the first position, wherein the first latch 310 is engaged with the first recess 316. In the first position, the first latch 310 may engage with the first recess 316 by interaction of complementary geometries of the first latch catch 328 and the first latch 310. As depicted in FIG. 6A, the complementary geometry of first latch 310 and first latch catch 328 comprises correspondingly angled surfaces, wherein the first latch 310 in a primary position relative to pivot pin 348 (as shown in FIG. 6A) is flush with first latch catch 328. Applying a force to The side plate (not shown) in a direction of the open position (towards the left as depicted in FIG. 6A), will be resisted by contact of first latch 310 with first latch catch 328, thereby preventing movement of the side plate (not shown) towards the open position while first latch 310 and first recess 316 are engaged. Disengaging first latch 310 from the first latch catch 328 may occur by actuating latching-cam 308 to pivot about a pivot pin 348 from a primary position to a secondary position, such that first latch 310 moves substantially upwards (in the positive-y-direction) and second latch 312 moves substantially downwards (in the negative-y-direction), inducing first latch 310 to slide out of first recess 316, while second latch 312 enters into second recess 318. The side plate (not shown) may then be actuated towards the open position until second latch 312 engages with second latch catch 326, thereby arresting the movement of the side plate (not shown). In this way, closure system 380 may transition from the first position to the second position.

Turning to FIG. 6B, closure system 380 is depicted in the second position, wherein the second latch 312 is engaged with the second recess 318. In the second position, the second latch 312 may engage with the second recess 318 by interaction of complementary geometries of the second latch catch 326 and the second latch 312. As depicted in FIG. 6B, the complementary geometry of second latch 312 and second latch catch 326 comprises corresponding flat planar surfaces, wherein while latching-cam 308 is in its secondary position (the angular position of latching 308 relative to the pivot pin 348, as depicted in FIG. 6B) second latch 312 may be flush with second latch catch 326. Applying a force to the side plate (not shown) in a direction of the open position (towards the left as depicted in FIG. 6B), may be resisted by contact of second latch 312 with second latch catch 326, thereby preventing movement of the side plate (not shown) towards the open position while second latch 312 and second recess 318 are engaged. Disengaging second latch 312 from the second latch catch 326 may occur by actuating latching-cam 308 to pivot about the pivot pin 348 from the secondary position to the primary position, such that second latch 312 moves substantially upwards (in the positive-y-direction) and first latch 310 moves substantially downwards (in the negative-y-direction), aligning second latch 312 with a passage out of second recess 318, thereby enabling second latch 312 to egress second recess 318, while first latch 310 enters into third recess 320. The side plate (not shown) may then be actuated towards the open position until first latch 310 engages with third latch catch 324, thereby arresting the movement of the side plate in the direction of the open position. In this way, closure system 380 may transition from the second position to the third position.

Turning to FIG. 6C, closure system 380 is depicted in the third position, wherein the first latch 310 is engaged with the third recess 320. In the third position, the first latch 310 may engage with the third recess 320 by interaction of complementary geometries of the third latch catch 324 and the first latch 310. As depicted in FIG. 6C, the complementary geometry of first latch 310 and third latch catch 324 comprises correspondingly angled surfaces, wherein while latching-cam 308 is in its primary position first latch 310 may be flush with third latch catch 324. Applying a force to the side plate (not shown) in a direction of the open position (towards the left as depicted in FIG. 6B), will be resisted by contact of first latch 310 with third latch catch 324, thereby preventing movement of the side plate (not shown) towards the open position while first latch 310 and third recess 320 are engaged. Disengaging first latch 310 from the third latch catch 324 may occur by actuating latching-cam 308 to pivot about pivot pin 348 from the primary position to the secondary position, such that first latch 310 moves substantially upwards (in the positive-y-direction) and second latch 312 moves substantially downwards (in the negative-y-direction), inducing first latch 310 to slide out of third recess 320. The side plate (not shown) may then be actuated towards the open position. In this way, closure system 380 may transition from the third position to the fourth position.

Turning to FIG. 6D, closure system 380 is depicted in the fourth, unlocked position, wherein the first latch 310 and second latch 312 are not engaged with any of the plurality of keepers (recesses) of closure system 380, and the side plate (not shown) may move towards the open position uninhibited.

Figure 7A:
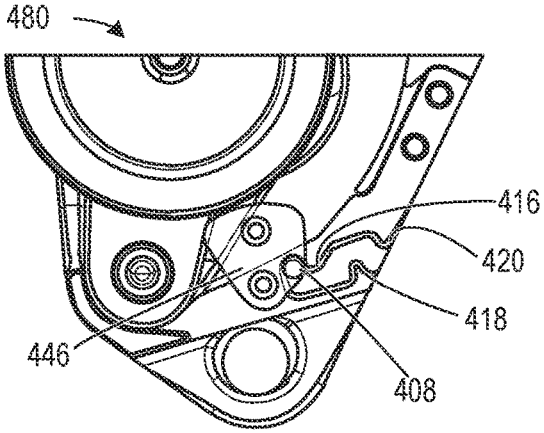
FIGS. 7A, 7B, 7C, and 7D show a fourth embodiment of the closure system being actuated from a locked position to an unlocked position.
Figure 7B:
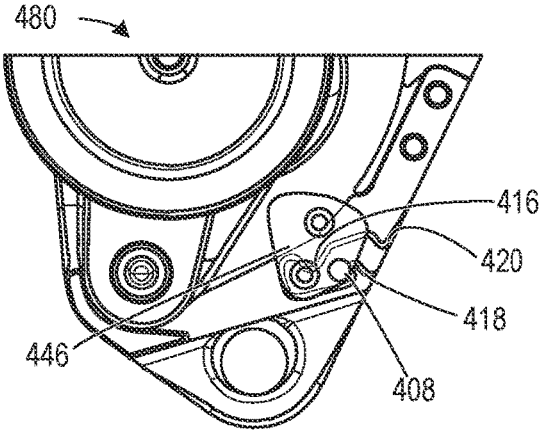
Figure 7C:
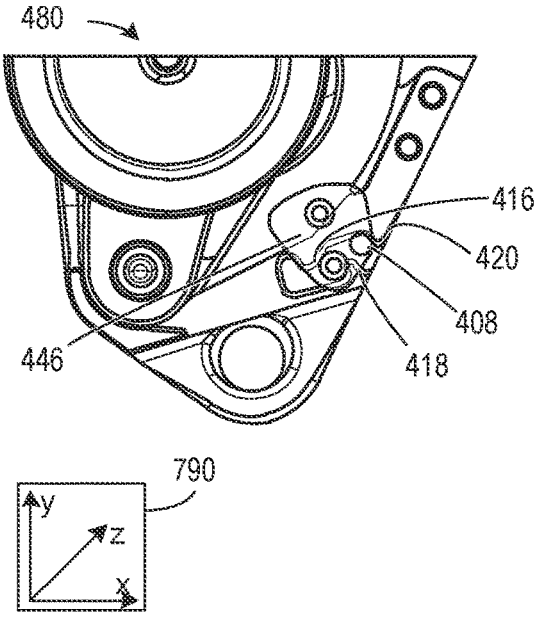
Figure 7D:
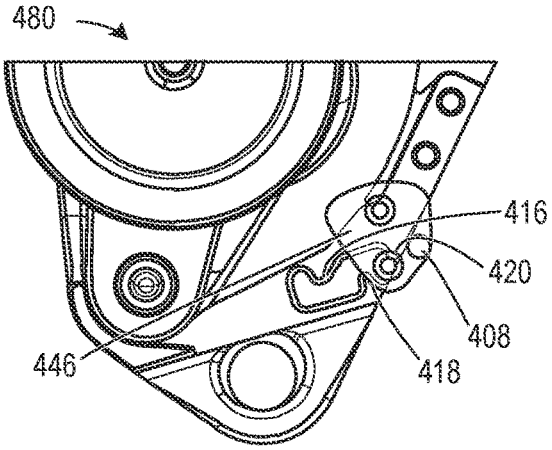
Figure 8:
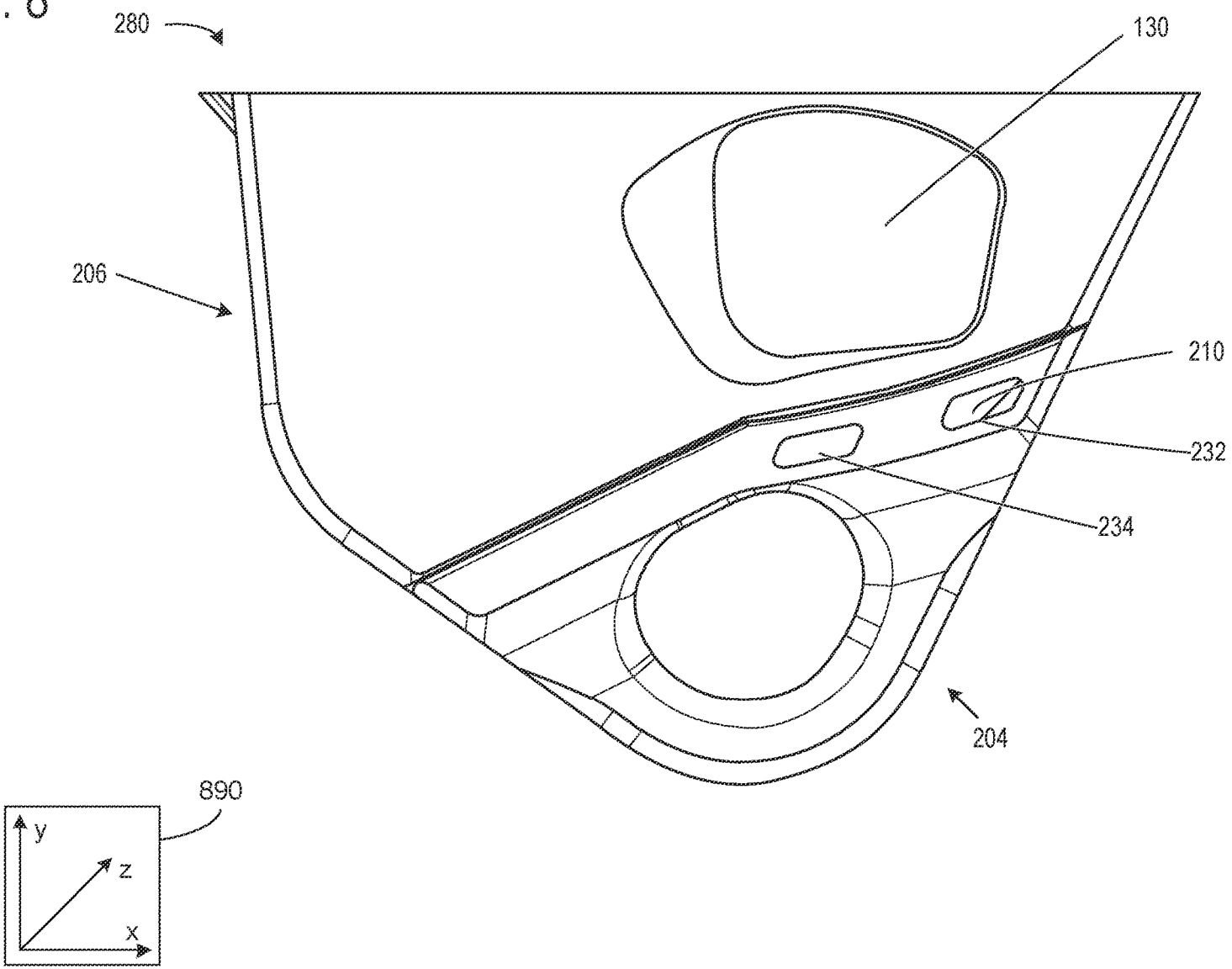
FIG. 8 shows a perspective view of the first embodiment of a closure system.

FIGS. 7A-7D depict a fourth embodiment of a closure system, closure system 480, transitioning from a first, fully locked, position to a fourth, unlocked, position by sequentially moving from the first position (FIG. 7A), to the second position (FIG. 7B), then to the third position (FIG. 7C), and finally to the fourth, unlocked, position (FIG. 7D). In order to show the internal components of closure system 480, the side plate of closure system 480 is not shown, however it will be appreciated that back plate 446 is pivotally coupled to the side plate of closure system 480. FIGS. 7A-7D include axis system 790 comprising three axes, namely an x-axis parallel to a horizontal direction, a y-axis parallel to a vertical direction, and a z-axis perpendicular to each of the horizontal and vertical directions. The plurality of keepers of closure system 480 comprise a first hook 416, a second hook 418, and a third hook 420, while the latch of closure system 480 comprises latch-pin 408 protruding from back plate 446, wherein back plate 446 is pivotally coupled to the side plate (not shown). latch-pin 408 comprises a cylindrical protrusion from back plate 446, but it will be appreciated that latch-pin 408 may comprise other geometries without departing from the scope of the current disclosure. In one example, latch-pin 408 may comprise a rectangular geometry. The shape of latch-pin 408 is configured to snuggly engage with the geometry of the first hook 416, the second hook 418, and the third hook 420. The plurality of keepers of closure system 480, similar to the plurality of keepers of the other closure system embodiments herein disclosed, may engaged with the latch in substantially a unidirectional manner, such that latch-pin 408 may necessarily sequentially engage with the first hook 416, the second hook 418, and the third hook 420 as closure system 480 is actuated from a locked position (the first position) towards an unlocked position (the fourth position), while latch-pin 408 may not engage with the first hook 416, the second hook 418, or the third hook 420, as closure system 480 is actuated from an unlocked position (the fourth position) to a locked position (the first position).

Turning to FIG. 7A, closure system 480 is depicted in the first position, wherein the latch-pin 408 is engaged with the first hook 416. In the first position, latch-pin 408 engages with the first hook 416 by interaction of complementary geometries between the latch-pin 408 and the first hook 410. As depicted in FIG. 7A, the complementary geometry of latch-pin 408 and first hook 416 comprises a curvature of first hook 416 snuggly fitting the outer diameter of latch-pin 408. Applying a force to the side plate (not shown) in a direction of the open position (towards the right as depicted in FIG. 7A), will be resisted by contact of latch-pin 408 with first hook 416, thereby preventing movement of the side plate towards the open position while latch-pin 408 and first hook 416 are engaged. Disengaging latch-pin 408 from the first hook 416 may occur by actuating back plate 446, causing latch-pin 408 to move substantially downwards (in the negative-y-direction), thereby inducing latch-pin 408 to slide out of first hook 416. The side plate (not shown) may then be actuated towards the open position (to the right) until latch-pin 408 engages with second hook 418, thereby arresting the movement of the side plate (not shown). In this way, closure system 480 may transition from the first position to the second position.

Turning to FIG. 7B, closure system 480 is depicted in the second position, wherein the latch-pin 408 is engaged with the second hook 418. In the second position, latch-pin 408 engages with the second hook 418 by interaction of complementary geometries between the latch-pin 408 and the second hook 418. As depicted in FIG. 7B, the complementary geometry of latch-pin 408 and second hook 418 comprises a curvature of second hook 418 snuggly fitting the outer diameter of latch-pin 408. Applying a force to the side plate (not shown) in a direction of the open position (towards the right as depicted in FIG. 7B), will be resisted by contact of latch-pin 408 with second hook 418, thereby preventing movement of the side plate towards the open position while latch-pin 408 and second hook 418 are engaged. Disengaging latch-pin 408 from the second hook 418 may occur by actuating back plate 446, causing latch-pin 408 to move substantially upwards (in the positive-y-direction), and thereby inducing latch-pin 408 to slide out of second hook 418. The side plate (not shown) may then be actuated towards the open position (to the right) until latch-pin 408 engages with third hook 420, thereby arresting the movement of the side plate (not shown). In this way, closure system 480 may transition from the second position to the third position.

Turning to FIG. 7C, closure system 480 is depicted in the third position, wherein the latch-pin 408 is engaged with the third hook 420. In the third position, latch-pin 408 engages with the third hook 420 by interaction of complementary geometries between the latch-pin 408 and the third hook 420. As depicted in FIG. 7C, the complementary geometry of latch-pin 408 and third hook 420 comprises a curvature of third hook 420 snuggly fitting the outer diameter of latch-pin 408. Applying a force to the side plate (not shown) in a direction of the open position (towards the right as depicted in FIG. 7C), will be resisted by contact of latch-pin 408 with third hook 420, thereby preventing movement of the side plate towards the open position while latch-pin 408 and third hook 420 are engaged. Disengaging latch-pin 408 from the third hook 420 may occur by actuating back plate 446, causing latch-pin 408 to move substantially downwards (in the negative-y-direction), thereby inducing latch-pin 408 to slide out of third hook 420. The side plate (not shown) may then be actuated towards the open position. In this way, closure system 480 may transition from the third position to the fourth position.

Turning to FIG. 7D, closure system 480 is depicted in the fourth, unlocked position, wherein latch-pin 408 is not engaged with any of the plurality of keepers (hooks) of closure system 480, and the side plate (not shown) may move towards the open position uninhibited.

Turning now to FIG. 8, a perspective view of closure system 180 in the first, fully locked position, is depicted. In the embodiment shown in FIG. 8 the actuator comprises sliding button 130, which may be resiliently biased towards a primary position (the position shown in FIG. 8), and actuated by a finger of the user to a secondary position. The actuation of the actuator from the primary position to the secondary position may be against a resilient biasing force enacted on sliding button 130 by a resilient biasing mechanism. In one example, actuation of sliding button 130 from the primary position to the secondary position occurs upon application of a force applied by a finger of a user to sliding button 130 in a direction substantially parallel with the plane of side plate 106, removal of the force may enable sliding button 130 to return from the secondary position to the primary position by action of the resilient biasing force applied by the resilient biasing mechanism. In one example, the resilient biasing mechanism comprises a torsion spring. Sliding button 130 may reside within a channel, indentation, or groove formed in an external surface of side plate 106, the groove being of dimensions enabling actuation of sliding button 130 from the primary position to the secondary position. In one example, the shape of sliding button 130 may be rectangular, circular, or polygonal in shape. Sliding button 130 and latching-cam 108 may be physically coupled, and therefore the resilient biasing mechanism may also resiliently bias the latching-cam 108 towards a primary position. In one example, the primary position of latching-cam 108 may facilitate engagement of the first latch 110 with the first recess 116 and third recess 120, while inhibiting engagement of the second latch 112 with the second recess 118. Additionally, FIG. 8 depicts first window 132 and second window 134 in the sides of first recess 116 and third recess 120, respectively. First window 132 visually indicates engagement of first latch 110 with first recess 116, by enabling a user to see into recess 116. Likewise, second window 134 visually indicates engagement of the first latch 110 with third recess 120 by enabling a user to see within the third recess 120. To facilitate said visual indication of engagement of the first latch 110 with the first recess 116 and/or third recess 120, latch 110 may be brightly colored. In one example first latch 110 may be colored red. In another example, first latch 110 may be colored so as to contrast with the color of body 104 and/or side plate 106.

FIGS. 9A-9D depict perspective views of closure system 180 being actuated from a locked position to an unlocked position by transitioning from the first, fully locked, position, through the second position, the third position, and to the fourth, unlocked, position.

Figure 9A:
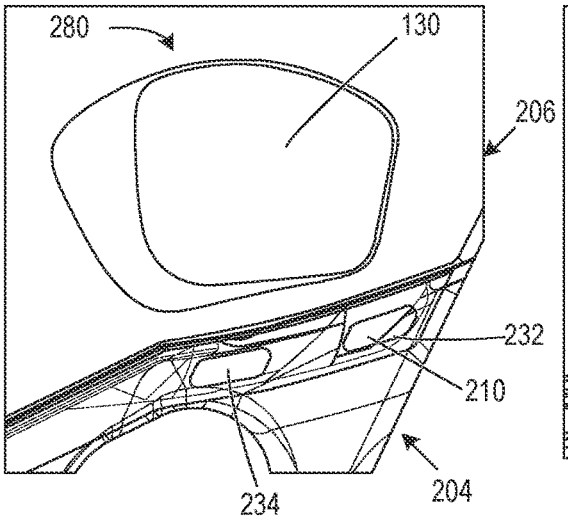
FIGS. 9A, 9B, 9C, and 9D show perspective views of the first embodiment of the closure system being actuated from a locked position to an unlocked position.

Starting with FIG. 9A, a perspective view of closure system 180 in the first, fully locked position, is depicted. A user of closure system 180 may uniquely determine that the closure system 180 is in the first position by observing the engagement of first latch 110 with first recess 116, as indicated by first window 132. In one example, first window 132 comprises a rectangular cutout of a portion of body 104 in a side wall of first recess 116. In another example, first window 132 may be rounded or polygonal in shape. In another example, first window 132 may comprise a transparent material inserted into a cutout of body 104 in a side wall of first recess 116, thereby preventing debris or dirt from infiltrating first recess 116 while enabling visual indication of the position of the closure system 180. Analogous to first window 132, second window 134 may comprise a rectangular cutout in a side wall of third recess 120, as depicted in FIG. 9A. In another example, the shape of second window 134 may comprise rounded or polygonal holes or passages in body 104 through a side wall of third recess 120, thereby enabling a visual indication of the position of closure system 180. In another example, second window 134 may comprise a transparent section of body 104, in a side wall of third recess 120. First window 132 and second window 134 may be configured to enable visual indication of the position of closure system 180 by providing the user with a direct line-of-sight into one or more of the plurality of recesses. In lieu of, or in addition to, first window 132 and second window 134, alternative means of indicating a position of closure system 180 may be provided. In one example, alternative means of indicating the position of closure system 180 may comprise a window or passage in side plate 106, which may be of various geometries, for providing a visual indication of an orientation of latching-cam 108.

As depicted in FIG. 9A, sliding button 130 is in a primary position, corresponding to a primary position of the latching-cam 108. The primary position of latching-cam 108 comprises a first angular position of latching-cam 108 relative to pivot pin 148 which places first latch 110 closer to, or deeper within, the plurality of recesses in body 104. As the latching-cam and sliding button 130 are physically coupled, when the sliding button (or actuator) 130 is in the primary position, the latching-cam 108 may be in a corresponding primary position, and likewise, while sliding button 130 is in the secondary position, latching-cam 108 may be in a corresponding secondary position. The primary position of the latching-cam 108 being the position in which the first latch 110 may fully engage with (be fully inserted into) first recess 116 or third recess 120, and the secondary position of the latching-cam 108 being the position in which the second latch 112 may be fully engaged with the second recess 118. The primary and secondary positions of latching-cam 108 may be defined based on an angular of rotation of latching-cam 108 relative to pivot pin 148. In one example, the primary position my correspond to a first angle, while the secondary position corresponds to a second angle, said angle being defined as the angle of a line connecting first latch 110 and pivot pin 148 relative to the y-axis. Actuating latching-cam 108 from the primary position to the secondary position may comprise anti-clockwise rotation of latching-cam 108 about pivot pin 148, and as the first latch 110 and the second latch 112 are on opposite sides of pivot pin 148, this rotation causes the first latch to move in a positive-y-direction (upwards, away from the plurality of recesses) and the second latch 112 to move in a negative-y-direction (downwards, towards the plurality of recesses). Sliding button 130 is configured such that actuation of sliding button 130 away from its primary position causes it to inter its secondary position. A resilient biasing mechanism (not shown), exerts a force on sliding button 130 towards its primary position, and exerts a clockwise torque on latching-cam 108 (relative to pivot pin 148). In the absence of opposing forces, the torque exerted on latching-cam 108 in the clockwise direction by the resilient biasing mechanism induces first latch 110 to be pressed towards the plurality of recesses, while inducing the second latch 112 to move away from the plurality of recesses. In one example, the biasing mechanism comprises a torsion spring exerting a torque in a clockwise direction onto latching-cam 108 about pivot pin 148, as viewed in from the orientation shown in FIG. 9A. The resilient biasing force may maintain the closure system in the first position even while the line-engaging device 100 changes orientation relative to the force of gravity, or experiences acceleration, such as may occur while rappelling. Closure system 180 may be actuated from the first position (shown in FIG. 9A) to the second position (shown in FIG. 9B) by a first actuation of sliding button 130 from its primary position to its secondary position, thereby inducing latching-cam 108 to pivot in an anti-clockwise direction about pivot pin 148, disengaging first latch 110 from first recess 116, while simultaneously engaging second latch 112 with second recess 118.

Figure 9B:
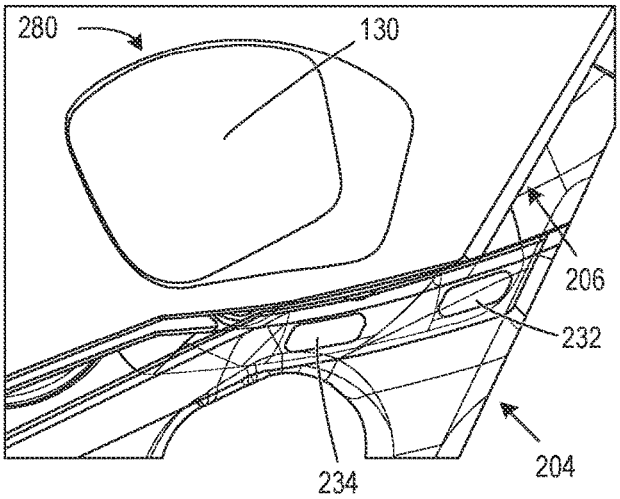

Turning now to FIG. 9B, a perspective view of closure system 180 in the second position is shown. In one example, a user may be able to uniquely identify that the closure system 180 is in the second position by observing that the side plate is locked (unable to freely pivot to the open position) and that first latch 110 is not engaged with either first recess 116, nor with third recess 120, as indicated by the first window 132 and the second window 134, respectively. Sliding button 130 is in its secondary position, being actuated against the force of the resilient biasing mechanism. In one example, the secondary position of sliding button 130 may be maintained against the force of the biasing mechanism by application of a force from a finger of a user on sliding button 130. From the second position of closure system 180, and in the absence of opposing forces, the resilient biasing mechanism may actuate the closure system to the third position by actuating the sliding button from the secondary position to the primary position, and by pivoting latching-cam 108 in a clockwise direction about pivot pin 148, resulting in the secondary latch 112 disengaging from the second recess 118 while the first latch 110 engages the third recess 120. In one example, removal of a force applied by a finger of a user from sliding button 130, while sliding button 130 is in its secondary position, and while closure system 180 is in the second position, may enable the resilient biasing force to actuate sliding button 130 back to its primary position while pivoting latching-cam 108 in a clockwise direction about pivot pin 148. Said another way, after a user actuates closure system 180 from the first position (shown in FIG. 9A) to the second position (FIG. 9B) by applying a force to sliding button 130, removal of that force may enable the closure system to transition from the second position to the third position (shown in FIG. 9C).

Figure 9C:
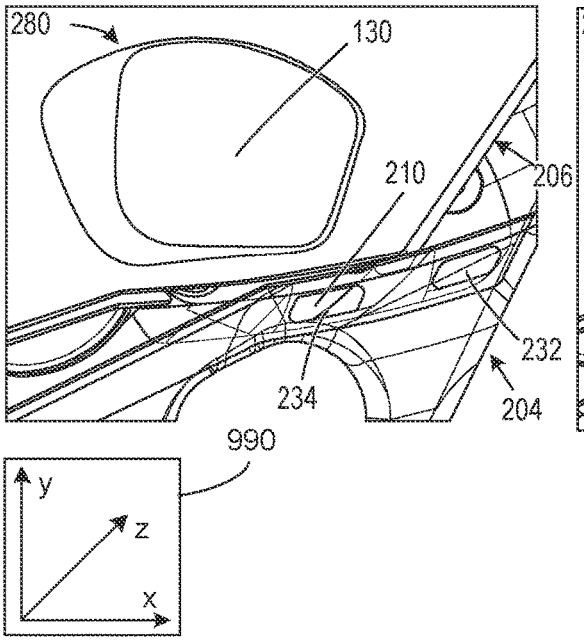

Turning now to FIG. 9C, a perspective view of closure system 180 in the third position is shown. In one example, a user may be able to uniquely identify that the closure system 180 is in the third position by observing that first latch 110 is engaged with third recess 120, as indicated by the second window 134. Sliding button 130 is in its primary position, and latching-cam 108 is in its primary position, thereby securing first latch 110 in third recess 120 and preventing closure system 180 from transitioning to the unlocked state. Closure system 180 may be actuated to the first position from the second or third positions by substantially a single actuation. In one example, closure system 180 may be returned to the first position from the third position by application of a force, by a hand of the user, to side plate 106 in a direction of the first position (towards the right as shown in FIG. 9C). Closure system 180 may be actuated from the third position, to the fourth, unlocked, position, by a second actuation of sliding button 130 from its primary position to its secondary position, thereby disengaging the first latch 110 from the third recess 120, and enabling side plate 106 to pivot towards the unlocked position (towards the left as shown in FIG. 9C).

Figure 9D:
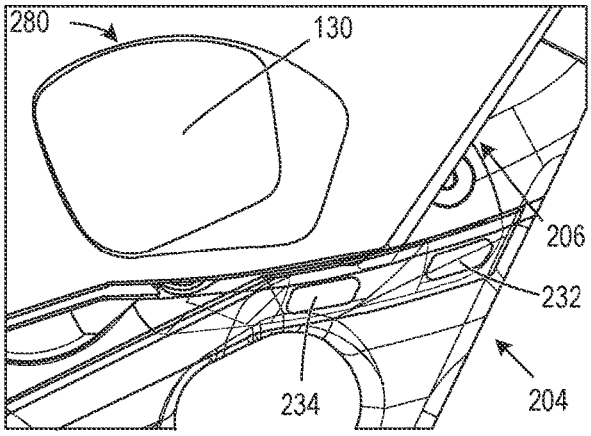

Proceeding to FIG. 9D, a perspective view of closure system 180 in the fourth position is shown. In one example, a user may be able to uniquely identify that the closure system 180 is in the third position by observing that side plate 106 is in an unlocked position and may rotate to an open position. Additionally, first latch 110 is not engaged with either the first recess 116, or the third recess 120, as indicated by the first window 132 and the second window 134. Sliding button 130 is in its secondary position, and latching-cam 108 is free from engagement with all of the plurality of recesses (keepers). As illustrated by FIGS. 9A-9D, unlocking closure system 180 (transitioning closure system 180 from the first, fully locked position, to the fourth unlocked position) necessarily comprises at least substantially two actuations of sliding button 130, thereby reducing a probability of unintentional unlocking of closure system 180.

Figure 10A:
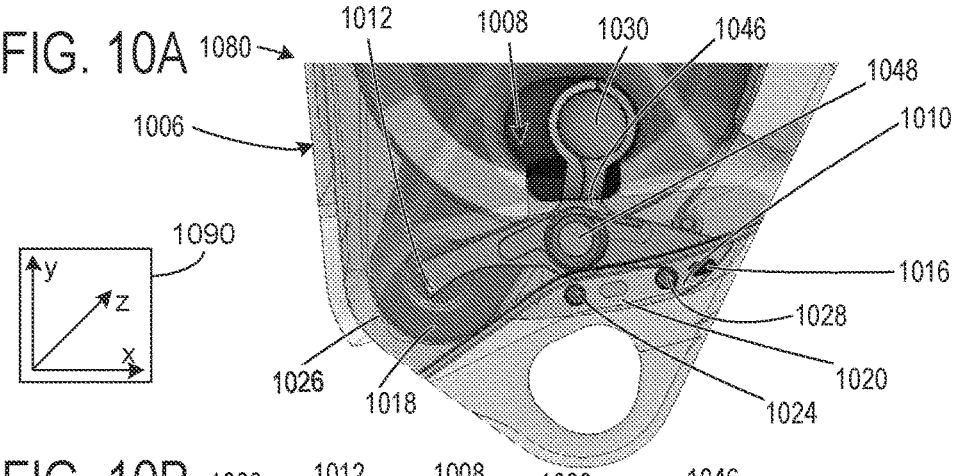
FIGS. 10A, 10B, 10C, and 10D show a fifth embodiment of the closure system being actuated from a locked position to an unlocked position.
Figure 10B:
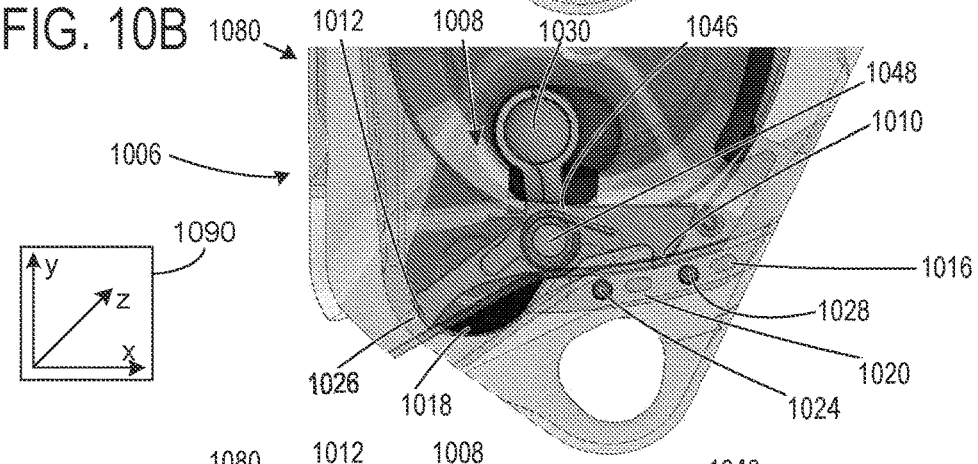
Figure 10C:
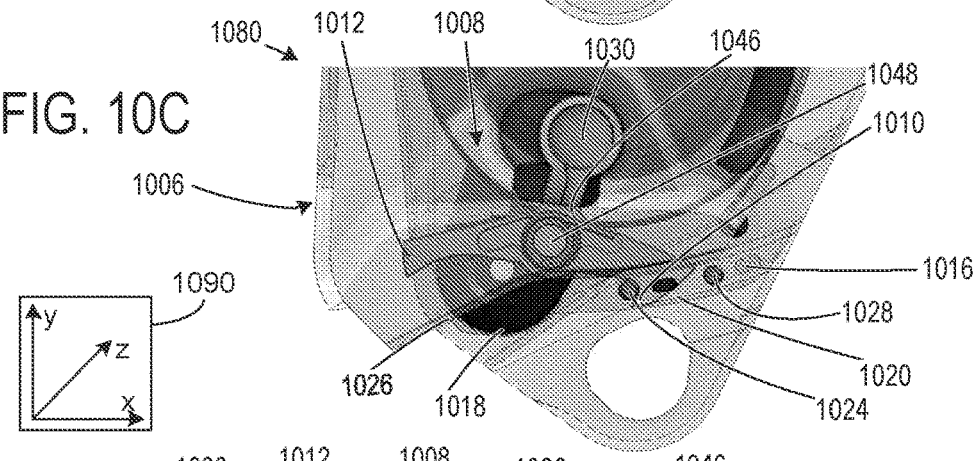
Figure 10D:
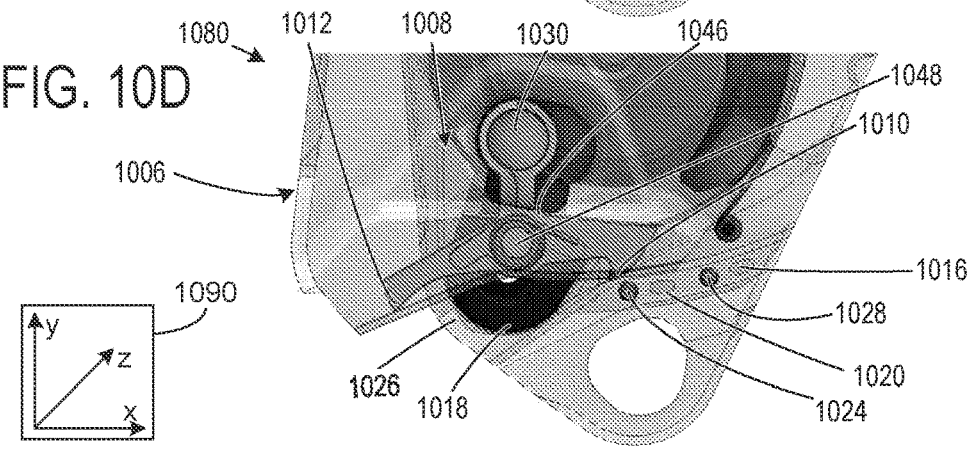

FIGS. 10A-10D depict a fifth embodiment of a closure system, closure system 1080, transitioning from a first, fully locked, position to a fourth, unlocked, position by sequentially moving from the first position (FIG. 10A), to the second position (FIG. 10B), then to the third position (FIG. 10C), and finally to the fourth, unlocked, position (FIG. 10D). In order to show the internal components of closure system 1080, the side plate 1006 of closure system 1080 is shown as being transparent, however it will be appreciated that side plate 1006 is shown as being transparent for illustrative purposes, and side plate 1006 is not limited to transparent embodiments. Further, latching-cam 1008 is pivotally coupled to the side plate 1006 of closure system 1080.

FIGS. 10A-10D include axis system 1090 comprising three axes, namely an x-axis parallel to a horizontal direction, a y-axis parallel to a vertical direction, and a z-axis perpendicular to each of the horizontal and vertical directions. The plurality of keepers of closure system 1080 comprise a first recess 1016, a second recess 1018, and a third recess 1020, while the latch of closure system 1080 comprises latching-cam 1008.

Latching-cam 1008 comprises a first latch 1010 and a second latch 1012 which protrude from latching-cam body 1046. First latch 1010 comprises an angular hook-like feature, which may engage with the first recess 1016 and the third recess 1020. Second latch 1012 comprises a substantially planar feature, which may engage with a substantially planar feature 1026 of second recess 1018, and may only disengaged second recess 1018 by passing through an opening, or passage, of second recess 1018.

Turning to FIG. 10A, closure system 1080 is depicted in the first position, wherein the first latch 1010 is engaged with the first recess 1016. In the first position, the first latch 1010 may engage with the first recess 1016 by interaction of complementary geometries of the first latch catch 1028 and the first latch 1010. As depicted in FIG. 10A, the complementary geometry of first latch 1010 and first latch catch 1028 comprises correspondingly rounded or curved surfaces, wherein the first latch 1010 in a primary position relative to pivot pin 1048 (as shown in FIG. 10A) is flush with first latch catch 1028. First latch catch 1028 may comprise a substantially rounded feature, such as a cylinder, or pin, which extends axially in a direction perpendicular to a plane of rotation of side plate 1006. Applying a force to the side plate 1006 in a direction of the open position (towards the left as depicted in FIG. 10A), will be resisted by contact of first latch 1010 with first latch catch 1028, thereby preventing movement of side plate 1006 towards the open position while first latch 1010 and first recess 1016 are engaged. Disengaging first latch 1010 from the first latch catch 1028 may occur by actuating sliding button 1030 from a primary position (the position of sliding button 1030 shown in FIG. 10A) to a secondary position (the position of sliding button 1030 shown in FIG. 10B) thereby causing latching-cam 1008 to pivot about a pivot pin 1048 from a primary position (the position of latching-cam 1008 shown in FIG. 10A) to a secondary position (the position of latching-cam 1008 shown in FIG. 10B), such that first latch 1010 moves substantially upwards (in the positive-y-direction) and second latch 1012 moves substantially downwards (in the negative-y-direction), inducing first latch 1010 to slide out of first recess 1016, while second latch 1012 enters into second recess 1018. The side plate 1006 may then be actuated towards the open position by rotating in a clockwise direction until second latch 1012 engages with second latch catch 1026, thereby arresting the movement of the side plate 1006. In this way, closure system 1080 may transition from the first position to the second position.

Turning to FIG. 10B, closure system 1080 is depicted in the second position, wherein the second latch 1012 is engaged with the second recess 1018. In the second position, the second latch 1012 may engage with the second recess 1018 by interaction of complementary geometries of the second latch catch 1026 and the second latch 1012. As depicted in FIG. 10B, the complementary geometry of second latch 1012 and second latch catch 1026 comprises corresponding flat, planar surfaces, wherein while latching-cam 1008 is in its secondary position (the angular position of latching 1008 relative to the pivot pin 1048, as depicted in FIG. 10B) second latch 1012 may be flush with second latch catch 1026. Applying a force to side plate 1006 in a direction of the open position (towards the left as depicted in FIG. 10B), may be resisted by contact of second latch 1012 with second latch catch 1026, thereby preventing movement of side plate 1006 towards the open position while second latch 1012 and second recess 1018 are engaged. Disengaging second latch 1012 from the second latch catch 1026 may occur by actuating sliding button 1030 from its secondary position (the position of sliding button 1030 shown in FIG. 10B) to its primary position (the position of sliding button 1030 shown in FIG. 10A) causing latching-cam 1008 to pivot about the pivot pin 1048 from the secondary position to the primary position, such that second latch 1012 moves substantially upwards (in the positive-y-direction) and first latch 1010 moves substantially downwards (in the negative-y-direction), aligning second latch 1012 with a passage out of second recess 1018, thereby enabling second latch 1012 to egress second recess 1018, while first latch 1010 enters into third recess 1020. Side plate 1006 may then be actuated towards the open position by rotating side plate 1006 clockwise until first latch 1010 engages with third latch catch 1024, thereby arresting the movement of the side plate 1006 in the direction of the open position. In this way, closure system 1080 may transition from the second position to the third position.

Turning to FIG. 10C, closure system 1080 is depicted in the third position, wherein the first latch 1010 is engaged with the third recess 1020. In the third position, the first latch 1010 may engage with the third recess 1020 by interaction of complementary geometries of the third latch catch 1024 and the first latch 1010. As depicted in FIG. 10C, the complementary geometry of first latch 1010 and third latch catch 1024 comprises correspondingly curved/rounded surfaces, wherein latch catch 1024 comprises a pin/cylinder having a substantially circular cross section, extending in the direction of an axis perpendicular to the plane of rotation of side plate 1006. While latching-cam 1008 is in its primary position first latch 1010 may be flush with third latch catch 1024. Applying a force to the side plate 1006 in a direction of the open position (towards the left as depicted in FIG. 10B), will be resisted by contact of first latch 1010 with third latch catch 1024, thereby preventing movement of the side plate (not shown) towards the open position while first latch 1010 and third recess 1020 are engaged. Disengaging first latch 1010 from the third latch catch 1024 may occur by actuating sliding button 1030 from a primary position (the position of sliding button 1030 shown in FIG. 10A) to a secondary position (the position of sliding button 1030 shown in FIG. 10B) thereby causing latching-cam 1008 to pivot about pivot pin 1048 from the primary position to the secondary position, such that first latch 1010 moves substantially upwards (in the positive-y-direction) and second latch 1012 moves substantially downwards (in the negative-y-direction), inducing first latch 1010 to slide out of third recess 1020. Side plate 1006 may then be actuated towards the open position. In this way, closure system 1080 may transition from the third position to the fourth position.

Turning to FIG. 10D, closure system 1080 is depicted in the fourth, unlocked position, wherein the first latch 1010 and second latch 1012 are not engaged with any of the plurality of keepers (recesses, pins) of closure system 1080, and the side plate 1006 may move towards the open position uninhibited.

The invention claimed is:

1. A closure system of a line-engaging device comprising:
- a plurality of keepers in a body of the line-engaging device;
- an actuator; and
- a latch moveably mounted to a side plate of the line-engaging device;
- the closure system actuatable by operation of the actuator to:
  - a first position wherein the latch is engaged with a first keeper of the plurality of keepers;
  - a second position wherein the latch is engaged with a second keeper of the plurality of keepers;
  - a third position wherein the latch is engaged with a third keeper of the plurality of keepers; and
  - a fourth position wherein the latch is not engaged with the plurality of keepers and a line may be engaged or disengaged with the line-engaging device,
- wherein transitioning from the first position to the second position includes actuation of the actuator in a first direction, transitioning from the second position to the third position includes actuation of the actuator in a second, substantially opposite, direction, and transitioning from the third position to the fourth position includes actuation of the actuator in the first direction.

2. The system of claim 1, wherein the latch comprises a latch-pin, and where the first keeper comprises a first hook for engaging the latch-pin in the first position, the second keeper comprises a second hook for engaging the latch-pin in the second position, and the third keeper comprises a third hook for engaging the latch-pin in the third position.

3. The system of claim 1, wherein actuating the actuator to disengage the latch from the first keeper causes the latch to engage with the second keeper.

4. The system of claim 1, wherein actuating the actuator to disengage the latch from the second keeper causes the latch to engage with the third keeper.

5. The system of claim 1, wherein actuating the closure system from the second position to the fourth position necessarily comprises actuating the closure system from the second position to the third position.

6. The system of claim 1, wherein the closure system only transitions from the first position to the fourth position following substantially two or more actuations of the actuator.

7. The system of claim 1, wherein the closure system transitions from the fourth position to the first position in substantially one actuation.

8. The closure system of claim 1, wherein the actuation of the actuator in the first direction is actuation of sliding button configured to operate by a force applied by a finger of a user to the sliding button against a resilient biasing force enacted by a resilient biasing mechanism, and the actuation of the actuator in the second direction is configured to operate by removal of the force by the user to enable the sliding button to return by action of the resilient biasing force applied by the resilient biasing mechanism.

9. The closure system of claim 1 wherein the latch is pivotally mounted to the side plate.

10. A closure system of a line-engaging device comprising:

a plurality of keepers in a body of the line-engaging device;

an actuator; and a latch pivotally mounted to a side plate of the line-engaging device;

the closure system actuatable by operation of the actuator to:

a first position wherein the latch is engaged with a first keeper of the plurality of keepers;

a second position wherein the latch is engaged with a second keeper of the plurality of keepers;

a third position wherein the latch is engaged with a third keeper of the plurality of keepers; and a fourth position wherein the latch is not engaged with the plurality of keepers and a line may be engaged or disengaged with the line-engaging device, wherein the latch is a latching-cam comprising:

a latching-cam body;

a first latch protruding from the latching-cam body;

a second latch protruding from the latching-cam body;

a pivot pin about which the latching-cam body pivots; and a pivot pin receiving hole located between the first latch and the second latch;

wherein the first keeper comprises a first recess for engaging the first latch in the first position, the second keeper comprises a second recess for engaging the second latch in the second position, and the third keeper comprises a third recess for engaging the first latch in the third position.

11. The system of claim 10, wherein engagement of the first latch with the first recess in the first position is visually indicated by a first window in a side of the first recess, and wherein engagement of the first latch with the third recess in the third position is visually indicated by a second window in a side of the third recess.

12. The system of claim 10, wherein the first latch occupies a first plane and the first latch does not intersect with a second plane, and the second latch occupies the second plane and the second latch does not intersect with the first plane, where the first plane and the second plane are non-intersecting planes.

13. The system of claim 12, wherein the first recess and third recess occupy the first plane and do not intersect with the second plane, and the second recess occupies the second plane and does not intersect with the first plane.

14. A closure system for a line-engaging device comprising:

a plurality of keepers in a body of the line-engaging device;

a latch pivotally mounted on a side plate of the line-engaging device for engaging with the plurality of keepers; and a resiliently biased actuator for actuating the latch;

wherein the closure system comprises a locked position for securing a line in the line-engaging device, wherein in the locked position the latch is engaged with a first keeper of the plurality of keepers and the line-engaging device cannot engage or disengage a bight of line, and wherein the closure system cannot transition from the locked position to an unlocked position in less than substantially two actuations of the actuator, wherein the latch comprises a latching-cam pivotable about a pivot pin by actuation of the actuator, the latching-cam comprising a first latch and a second latch protruding from a body of the latching-cam, wherein the plurality of keepers comprise a plurality of recesses for engaging the first latch and the second latch of the latching-cam.

15. The system of claim 14, wherein the closure system transitions from the locked position to the unlocked position by first occupying an intermediate position, wherein the intermediate position comprises engagement of the latch with at least a second keeper.

* * * * *